US010088792B2

(12) United States Patent
Shiokawa

(10) Patent No.: US 10,088,792 B2
(45) Date of Patent: Oct. 2, 2018

(54) IMAGE FORMING APPARATUS

(71) Applicant: Konica Minolta, Inc., Chiyoda-ku, Tokyo (JP)

(72) Inventor: Yasuo Shiokawa, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/661,425

(22) Filed: Jul. 27, 2017

(65) Prior Publication Data

US 2018/0052415 A1 Feb. 22, 2018

(30) Foreign Application Priority Data

Aug. 18, 2016 (JP) ..... 2016-160587

(51) Int. Cl.
*B65H 85/00* (2006.01)
*G03G 15/00* (2006.01)
(Continued)

(52) U.S. Cl.
CPC ..... *G03G 15/6529* (2013.01); *B65H 1/266* (2013.01); *B65H 5/26* (2013.01); *B65H 7/00* (2013.01); *B65H 29/585* (2013.01); *B65H 29/60* (2013.01); *B65H 85/00* (2013.01); *G03G 15/234* (2013.01); *B65H 2301/333* (2013.01); *B65H 2301/33312* (2013.01); *B65H 2511/11* (2013.01); *B65H 2513/42* (2013.01); *B65H 2601/11* (2013.01); *B65H 2801/06* (2013.01);
(Continued)

(58) Field of Classification Search
CPC .. B65H 29/60; B65H 85/00; B65H 2301/333; B65H 2301/3331; B65H 2301/33312; B65H 2301/33314; G03G 15/234; G03G 15/6579
See application file for complete search history.

(56) References Cited

U.S. PATENT DOCUMENTS 6,778,787 B2 * 8/2004 Kinoshita ..... G03G 15/234 399/16
7,760,216 B2 * 7/2010 Tseng ..... B65H 5/062 347/139
(Continued)

FOREIGN PATENT DOCUMENTS

JP 2006-124100 A 5/2006

*Primary Examiner* — Jeremy R Severson
(74) *Attorney, Agent, or Firm* — Buchanan Ingersoll & Rooney PC

(57) ABSTRACT

An image forming apparatus includes: an image forming part that forms an image on a paper sheet; a first conveyance path that conveys the paper sheet on which the image is formed and that includes a primary conveyance path; a second conveyance path that reverses the paper sheet and includes a reverse conveyance path; a connecting conveyance path that connects the second conveyance path to the first conveyance path, and, before reversal at a time of conveyance to the second conveyance path, sends the paper sheet to the first conveyance path, starting from one edge of the paper sheet; and a return conveyance path that connects the second conveyance path to the first conveyance path, and, after the reversal at a time of conveyance to the second conveyance path, sends the paper sheet to the first conveyance path, starting from the other edge of the paper sheet.

17 Claims, 19 Drawing Sheets

(51) Int. Cl.

| | |
|---|---|
| ***B65H 1/26*** | (2006.01) |
| ***B65H 5/26*** | (2006.01) |
| ***B65H 29/58*** | (2006.01) |
| ***B65H 29/60*** | (2006.01) |
| ***B65H 7/00*** | (2006.01) |
| ***G03G 15/23*** | (2006.01) |
| *G03G 15/01* | (2006.01) |

(52) U.S. Cl.
CPC ..... *G03G 15/0189* (2013.01); *G03G 15/6564* (2013.01); *G03G 15/6579* (2013.01)

(56) References Cited

U.S. PATENT DOCUMENTS

| | | | | |
|---|---|---|---|---|
| 8,794,730 | B2 * | 8/2014 | Yamamoto | B41J 3/543 347/104 |
| 8,998,204 | B2 * | 4/2015 | Kobayashi | B65H 5/062 271/264 |
| 9,150,376 | B2 * | 10/2015 | Takahashi | B65H 85/00 |
| 2010/0143013 | A1 * | 6/2010 | Azeta | G03G 15/234 399/381 |
| 2010/0278575 | A1 * | 11/2010 | Mizuno | G03G 15/234 399/401 |
| 2013/0256982 | A1 * | 10/2013 | Kawanago | G03G 15/234 271/225 |
| 2017/0097604 | A1 * | 4/2017 | Nakamura | G03G 15/6567 |

* cited by examiner

IMAGE FORMING APPARATUS

Japanese Patent Application No. 2016-160587 filed on Aug. 18, 2016, including description, claims, drawings, and abstract the entire disclosure is incorporated herein by reference in its entirety.

BACKGROUND

Technological Field

The present invention relates to an image forming apparatus that forms an image by transferring and fixing a toner image onto a paper sheet.

Description of the Related Art

Image forming apparatuses that form an image on a paper sheet with toner have been known. In such an image forming apparatus, a reverse conveyance path that forms a conveyance path for reversing each paper sheet is provided so that images can be formed on both surfaces of each paper sheet as each paper sheet is reversed (see JP 2006-124100 A, for example).

In a conventional image forming apparatus, a conveyance path that reverses a paper sheet in the reverse conveyance path is formed. Therefore, paper sheets that can be reversed in the reverse conveyance path are limited by the length of the reverse conveyance path.

In recent years, there is an increasing demand for formation of images on both surfaces of a paper sheet called a long paper sheet that is too large to be stored in a paper cassette. However, in order for a long paper sheet to be reversed, the length of the reverse conveyance path needs to be increased, and, as a result, the apparatus becomes larger in size.

Also, in a case where the reverse conveyance path is made longer so that a long paper sheet can be reversed, the reverse conveyance path may be extended outside the unit that houses the reverse conveyance path. In such a structure, conveyance may be suspended if a long paper sheet is stuck at a position between the reverse conveyance path inside the unit that can be pulled out of the apparatus main body and the reverse conveyance path extended outside the unit.

SUMMARY

The present invention has been made to solve the above problem, and an object thereof is to provide an image forming apparatus.

To achieve the abovementioned object, according to an aspect of the present invention, an image forming apparatus reflecting one aspect of the present invention comprises: an image forming part that forms an image on a paper sheet; a first conveyance path that conveys the paper sheet on which the image is formed by the image forming part, the first conveyance path including at least a primary conveyance path; a second conveyance path that reverses the paper sheet, the second conveyance path including at least a reverse conveyance path; a connecting conveyance path that connects the second conveyance path to the first conveyance path, and, before reversal at a time of conveyance to the second conveyance path, sends the paper sheet to the first conveyance path, starting from one edge of the paper sheet, the one edge being a top edge in a conveyance direction; and a return conveyance path that connects the second conveyance path to the first conveyance path, and, after the reversal at a time of conveyance to the second conveyance path, sends the paper sheet to the first conveyance path, starting from the other edge of the paper sheet, the other edge being a top edge in a conveyance direction.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of an image forming apparatus according to the present invention will be described with reference to the drawings. However, the scope of the invention is not limited to the disclosed embodiments.

<Example Structure of an Image Forming Apparatus According to an Embodiment>

Figure 1:
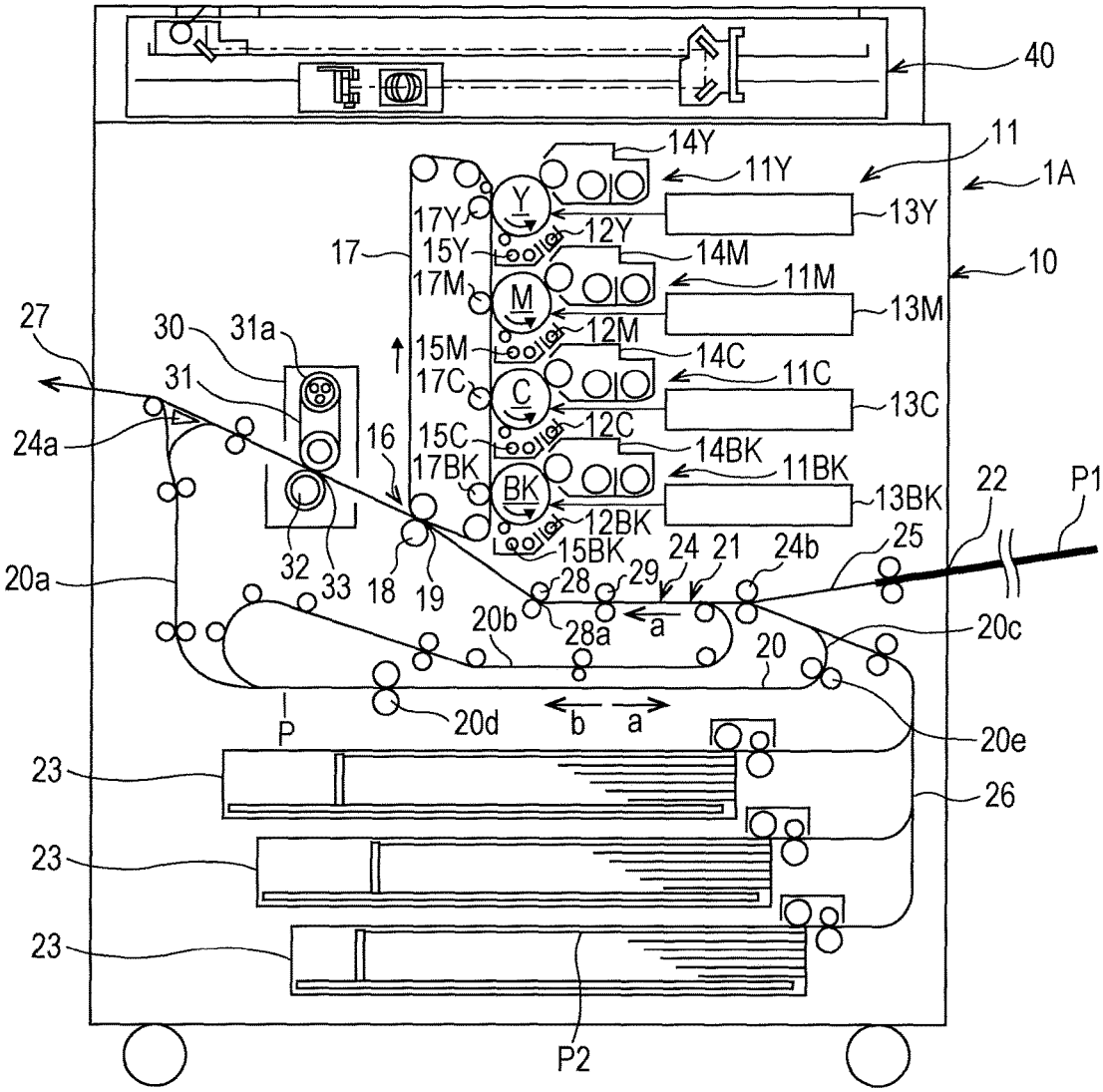
FIG. 1 is a diagram showing an example structure of an image forming apparatus according to an embodiment.
Figure 2:
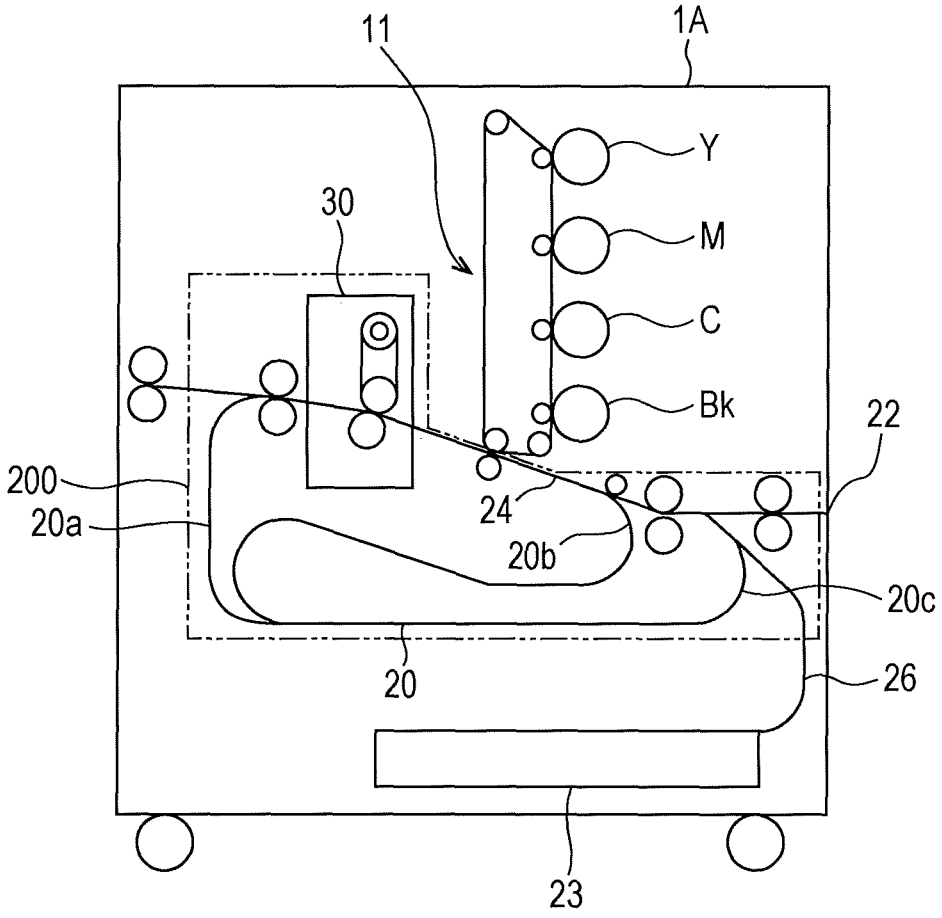
FIG. 2 is a diagram showing an example structure of the image forming apparatus according to this embodiment.

FIGS. 1 and 2 are diagrams showing an example structure of an image forming apparatus according to an embodiment. An image forming apparatus 1A of this embodiment is an electrophotographic image forming apparatus. In this example, the image forming apparatus 1A is a tandem color image forming apparatus that has photosensitive members vertically arranged to face a single intermediate transfer belt, and forms full-color images.

In the following, the image forming apparatus 1A is described in detail. The image forming apparatus 1A includes an image forming part 11 that forms images on paper sheets that have been cut to have a predetermined length, such as long paper sheets P1 or paper sheets P2, or roll paper. The image forming apparatus 1A includes a conveyor 21 that conveys paper sheets or the like. In the description below, paper sheets and roll paper on which images can be formed in the image forming apparatus 1A will be collectively referred to as paper sheets or the like.

First, the structure that forms images on paper sheets or the like is described. The image forming part 11 is an example of an image forming means, and forms an image on a paper sheet or the like through processes of charging, exposure, transfer, and fixing. The image forming part 11 includes a toner image forming part 11Y that forms a yellow (Y) toner image, a toner image forming part 11M that forms a magenta (M) toner image, a toner image forming part 11C that forms a cyan (C) toner image, and a toner image forming part 11BK that forms a black (BK) toner image.

The toner image forming part 11Y includes a photosensitive drum Y, and a charging unit 12Y, an optical writing unit 13Y, a development device 14Y, and a drum cleaner 15Y, which are placed around the photosensitive drum Y. Likewise, the toner image forming parts 11M, 11C, and 11BK include photosensitive drums M, C, and BK, and charging units 12M, 12C, and 12BK, optical writing units 13M, 13C, and 13BK, development devices 14M, 14C, and 14BK, and drum cleaners 15M, 15C, and 15BK, which are placed around the photosensitive drums M, C, and BK, respectively.

The development devices 14Y, 14M, 14C, and 14BK are an example of a development means, and the development device 14Y supplies toner to the photosensitive drum Y that is a photosensitive member. Also, the development device 14M supplies toner to the photosensitive drum M that is a photosensitive member, the development device 14C supplies toner to the photosensitive drum C that is a photosensitive member, and the development device 14BK supplies toner to the photosensitive drum BK that is a photosensitive member.

The photosensitive drum Y is an example of an image carrier. The surface of the photosensitive drum Y is uniformly charged by the charging unit 12Y, and the optical writing unit 13Y performs scanning exposure, so that a latent image is formed on the photosensitive drum Y. Toner is supplied from the development device 14Y to the photosensitive drum Y, so that the latent image is developed and visualized. As a result, a toner image corresponding to yellow is formed as an image in a predetermined color on the photosensitive drum Y.

The photosensitive drum M is an example of an image carrier. The surface of the photosensitive drum M is uniformly charged by the charging unit 12M, and the optical writing unit 13M performs scanning exposure, so that a latent image is formed on the photosensitive drum M. Toner is supplied from the development device 14M to the photosensitive drum M, so that the latent image is developed and visualized. As a result, a toner image corresponding to magenta is formed on the photosensitive drum M.

The photosensitive drum C is an example of an image carrier. The surface of the photosensitive drum C is uniformly charged by the charging unit 12C, and the optical writing unit 13C performs scanning exposure, so that a latent image is formed on the photosensitive drum C. Toner is supplied from the development device 14C to the photosensitive drum C, so that the latent image is developed and visualized. As a result, a toner image corresponding to cyan is formed on the photosensitive drum C.

The photosensitive drum BK is an example of an image carrier. The surface of the photosensitive drum BK is uniformly charged by the charging unit 12BK, and the optical writing unit 13BK performs scanning exposure, so that a latent image is formed on the photosensitive drum BK. Toner is supplied from the development device 14BK to the photosensitive drum BK, so that the latent image is developed and visualized. As a result, a toner image corresponding to black is formed on the photosensitive drum BK.

The image forming part 11 includes a transfer unit 16 that transfers toner images onto a paper sheet or the like. The transfer unit 16 is an example of a transfer means, and includes: an intermediate transfer belt 17 onto which the toner images formed on the respective photosensitive drums Y, M, C, and BK are transferred in the primary transfer process; and a secondary transfer roller 18 that transfers the toner images transferred onto the intermediate transfer belt 17 in the primary transfer process, onto a paper sheet or the like.

The intermediate transfer belt 17 is an example of an image carrier, and is provided on the side that faces one of the surfaces of the paper sheet or the like being conveyed in the conveyor 21. As the intermediate transfer belt 17 is driven in the direction indicated by an arrow, the toner images formed on the photosensitive drums Y, M, C, and BK are sequentially transferred onto a predetermined position on the intermediate transfer belt 17 by primary transfer rollers 17Y, 17M, 17C, and 17BK.

The secondary transfer roller 18 is an example of a secondary transfer means, and is provided on the side facing the other surface of the paper sheet or the like being conveyed in the conveyor 21, to face the intermediate transfer belt 17. In the transfer unit 16, the secondary transfer roller 18 is designed to be movable in the direction toward the intermediate transfer belt 17. When the secondary transfer roller 18 is pressed against the intermediate transfer belt 17, a transfer nip portion 19 is formed.

The secondary transfer roller 18 applies a positive voltage from the side of the other surface of the paper sheet or the like. With this, the one surface of the paper sheet or the like passing between the secondary transfer roller 18 and the intermediate transfer belt 17 is negatively charged, and the other surface is positively charged, the toner images being transferred onto the one surface serving as the image formation surface.

At the transfer nip portion 19, the secondary transfer roller 18 is rotatively driven at the same speed as the intermediate transfer belt 17, in synchronization with the conveyance of the paper sheet by the conveyor 21. As a result, the paper sheet or the like being conveyed by the conveyor 21 enters between the secondary transfer roller 18 and the intermediate transfer belt 17, and is pressed against the intermediate transfer belt 17 by the secondary transfer roller 18. Thus, the toner images in the respective colors transferred onto the intermediate transfer belt 17 in the primary transfer process are further transferred onto the paper sheet or the like being conveyed between the intermediate transfer belt 17 and the secondary transfer roller 18 in the secondary transfer process. It should be noted that the image forming part 11 may perform not only the above described color process but also a monochrome process. In the case of a monochrome process, a toner image transferred onto the intermediate transfer belt in the primary transfer process is not necessarily transferred onto a paper sheet or the like, and a toner image may be transferred directly from a photosensitive drum onto a paper sheet or the like.

The image forming apparatus 1A includes a fixing unit 30 that fixes toner images onto a paper sheet or the like. The fixing unit 30 is an example of a fixing means, and performs a fixing process on the paper sheet or the like having the toner images transferred thereonto, to fix the toner images to the paper sheet or the like. The fixing unit 30 includes a fixing belt 31 that heats a paper sheet or the like, and a pressure roller 32 that presses the paper sheet or the like against the fixing belt 31.

The fixing belt 31 is an example of a heating rotary member. The fixing belt 31 is provided on the side that faces the one surface of the paper sheet or the like onto which the toner images have been transferred by the transfer unit 16. As the energization of a heater 31*a* is controlled, the temperature of the fixing belt 31 to be applied to the paper sheet or the like is controlled. The pressure roller 32 is an example of a pressing rotary member, and is provided on the side that faces the other surface of the paper sheet or the like. The fixing belt 31 and the pressure roller 32 are rotatively driven, independently of each other.

As the pressure roller 32 is pressed against the fixing belt 31, a fixing nip portion 33 is formed in the fixing unit 30. With the pressure roller 32 being pressed against the fixing belt 31, the pressure roller 32 is rotatively driven. As the heater 31*a* is energized, the paper sheet or the like nipped at the fixing nip portion 33 is conveyed, and the image is fixed onto the paper sheet or the like by pressure and heat.

Next, the structure that conveys paper sheets or the like is described. The image forming apparatus 1A includes an external paper feed port 22 through which long paper sheets P1 are loaded, and paper cassettes 23 in which paper sheets P2 are stored. The external paper feed port 22 is formed at one side of the apparatus main body 10. The paper cassettes 23 are provided at a lower portion of the apparatus main body 10 in such a manner that the paper cassettes 23 can be pulled out of the apparatus main body 10.

A long paper sheet P1 having a greater length in the conveyance direction than a first length the paper cassettes 23 can accommodate in this example is loaded into the image forming apparatus 1A from the outside of the apparatus main body 10 through the external paper feed port 22. Meanwhile, a paper sheet P2 having a smaller length in the conveyance direction than the first length the paper cassettes 23 can accommodate is loaded into the image forming apparatus 1A from a paper cassette 23 in the apparatus main body 10.

The conveyor 21 is an example of a conveyance means, and is formed with a first conveyance path and a second conveyance path. The first conveyance path is a path through which a paper sheet or the like is conveyed when an image is formed on one of the surfaces of the paper sheet or the like. The first conveyance path includes at least a primary conveyance path 24 through which a paper sheet or the like on which an image is to be formed by the image forming part 11. The second conveyance path includes at least a reverse conveyance path 20 that reverses a paper sheet. The primary conveyance path 24 conveys each paper sheet or the like at least via resist rollers 28, the transfer unit 16, and the fixing unit 30.

The conveyor 21 also includes an external paper conveyance path 25 that conveys each paper sheet such as a long paper sheet P1 loaded through the external paper feed port 22 to the primary conveyance path 24, and a loaded paper conveyance path 26 that conveys each paper sheet P2 loaded from a paper cassette 23 to the primary conveyance path 24.

The primary conveyance path 24 is formed above the paper cassettes 23 inside the apparatus main body 10, and extends from the one side of the apparatus main body 10 toward the other side. One end of the primary conveyance path 24 connects to the external paper conveyance path 25 and the loaded paper conveyance path 26. Meanwhile, the other end of the primary conveyance path 24 connects to a discharge port 27 formed at the other side of the apparatus main body 10.

One end of the external paper conveyance path 25 connects to the external paper feed port 22, and the other end connects to the primary conveyance path 24. The paper conveyance path 26 is formed at one side of the inside of the apparatus main body 10, and vertically extends from the paper cassettes 23 to the primary conveyance path 24. The upper end of the paper conveyance path 26 connects to the primary conveyance path 24, and the lower end connects to the paper cassettes 23.

The conveyor 21 includes the resist rollers 28 that correct a tilt (called skew) of a paper sheet being conveyed in the primary conveyance path 24 in the forward direction, and deviation of the position of the paper sheet in the main scanning direction, which is the width direction perpendicular to the conveyance direction. The conveyor 21 also includes loop rollers 29 that bring each paper sheet into contact with the resist rollers 28.

The resist rollers 28 are an example of a shaking member, and are formed with a pair of rollers that face each other and nip the paper sheet being conveyed in the primary conveyance path 24. The resist rollers 28 each have a shaft perpendicular to the direction of conveyance of the paper sheet, and rotate in the direction of conveyance of the paper sheet.

The loop rollers 29 are formed with a pair of rollers that face each other and nip the paper sheet being conveyed in the primary conveyance path 24. The loop rollers 29 are provided on the upstream side of the resist rollers 28 in the direction of conveyance of the paper sheet. The loop rollers 29 each have a shaft perpendicular to the direction of conveyance of the paper sheet, and rotate in the direction of conveyance of the paper sheet, to convey the paper sheet.

While the resist rollers 28 are stopped, the loop rollers 29 convey the paper sheet, and bring the top edge of the paper sheet into contact with a nip portion 28*a* formed with the contact portion between the pair of rollers. The paper sheet is then conveyed until being bent into a loop, so that the tilt of the paper sheet in the direction parallel to the surfaces of the paper sheet is corrected.

After the tilt of the paper sheet is corrected, the resist rollers 28 are driven and rotated in the direction of conveyance of the paper sheet, so that the paper sheet is conveyed while nipped. Further, the resist rollers 28 are moved in the main scanning direction, so that the position of the paper sheet in the main scanning direction is corrected. The series of paper position correcting operations to correct deviation of the position of the paper sheet in the main scanning direction as described above are called resist shaking.

The reverse conveyance path 20 is formed between the paper cassettes 23 and the primary conveyance path 24 inside the apparatus main body 10, and extends from the other side of the apparatus main body 10 toward the one side. The reverse conveyance path 20 includes a first return conveyance path 20*a* that branches from the primary conveyance path 24 toward the bottom on the downstream side of the fixing unit 30 of the image forming part 11 in the direction of conveyance of the paper sheet being conveyed in the primary conveyance path 24, and a second return conveyance path 20*b* that joins the primary conveyance path 24 on the upstream side of the transfer unit 16 of the image forming part 11. The other end of the reverse conveyance path 20 connects to the first return conveyance path 20*a* and the second return conveyance path 20*b*. In the apparatus main body 10, the reverse conveyance path 20 is not necessarily located between the paper cassettes 23 and the primary conveyance path 24.

The reverse conveyance path 20 also includes a connecting conveyance path 20*c* that connects the one end and the primary conveyance path 24. The connecting conveyance path 20*c* joins the primary conveyance path 24 on the upstream side of the loop rollers 29 in the direction of conveyance of the paper sheet being conveyed in the forward direction. In this example, the conveyance path in which the connecting conveyance path 20*c* joins the primary conveyance path 24 is formed on the upstream side of the joining point between the primary conveyance path 24 and the second return conveyance path 20*b*. The connecting conveyance path 20*c* joins the primary conveyance path 24 in the direction in which each paper sheet is conveyed in the forward direction in the primary conveyance path 24.

In the reverse conveyance path 20, the conveyance direction indicated by an arrow "a" in which each paper sheet is conveyed from the first return conveyance path 20*a* is referred to as the forward direction, and the conveyance direction indicated by an arrow "b" in which each paper sheet is conveyed to the second return conveyance path 20*b* is referred to as the backward direction.

In the reverse conveyance path 20, a switchback point P is formed on the downstream side of the branching point between the first return conveyance path 20*a* and the second return conveyance path 20*b* in the conveyance direction of the paper sheet being conveyed in the forward direction.

The reverse conveyance path 20 also includes conveyance rollers 20*d* that convey each paper sheet, on the downstream side of the switchback point P in the direction of conveyance of the paper sheet being conveyed in the forward direction. The reverse conveyance path 20 further includes guide rollers 20*e* that guide the paper sheet being conveyed in the connecting conveyance path 20*c*, which is a curved conveyance path.

The drive force of a motor (not shown) is transmitted to the conveyance rollers 20*d*, and the conveyance rollers 20*d* convey each paper sheet both in the forward direction and in the backward direction. The guide rollers 20*e* rotate, following the paper sheet being conveyed. The drive force of a motor (not shown) may be transmitted to the guide rollers 20*e*, and the guide rollers 20*e* may convey each paper sheet both in the forward direction and in the backward direction. Also, the guide rollers 20*e* may be designed to be capable of moving between a conveyance guide position that is in contact with the paper sheet being conveyed in the connecting conveyance path 20*c* and guides the paper sheet being conveyed, and a retraction position that is not in contact with the paper sheet.

In the image forming apparatus 1A, an image is formed on the upward-facing surface of the paper sheet that has been conveyed in the forward direction through the primary conveyance path 24 and has passed through the fixing unit 30. In a case where images are to be formed on both surfaces of a paper sheet, the paper sheet having an image formed on the surface facing upward is conveyed from the primary conveyance path 24 to the reverse conveyance path 20 through the first return conveyance path 20*a*. The direction of conveyance of the paper sheet is then reversed, and the paper sheet is conveyed from the reverse conveyance path 20 to the primary conveyance path 24 through the second return conveyance path 20*b*, so that the image-formed surface faces downward. The paper sheet is reversed in this manner, and an image can be formed on the other surface that now faces upward.

The conveyor 21 includes a switching gate 24*a* that switches the conveyance direction at the branching point between the primary conveyance path 24 and the first return conveyance path 20*a*. The conveyance paths are switched in accordance with the settings, such as two-side printing.

The conveyor 21 includes guide rollers 24*b* that guide the paper sheet being conveyed in the primary conveyance path 24. The guide rollers 24*b* are an example of a conveyance member, and rotate, following the paper sheet being conveyed. The guide rollers 24*b* may be designed to be supported by one-way bearings, so as to limit the rotating direction in which the guide rollers 24*b* rotate following the paper sheet being conveyed in the forward direction. Also, the guide rollers 24*b* may be designed to be capable of moving between a conveyance guide position that is in contact with the paper sheet being conveyed in the primary conveyance path 24 and guides the paper sheet being conveyed, and a retraction position that is not in contact with the paper sheet. After a paper sheet or the like is conveyed in the forward direction and then in the backward direction, the guide rollers 20*e*, the guide rollers 24*b*, and other guide rollers switch the conveyance direction from the backward direction to the forward direction before the top edge of the next paper sheet or the like reaches the respective guide rollers. Further, after moving from the conveyance guide positions to the retraction positions, the guide rollers 20*e*, the guide rollers 24*b*, and other guide rollers move from the retraction positions to the conveyance guide positions before the top edge of the next paper sheet or the like reaches the respective guide rollers.

The image forming apparatus 1A includes a document reading unit 40. The document reading unit 40 scans and exposes an image of a document with an optical system of a scanning exposure device, reads the reflected light with a line image sensor, and thus obtains an image signal. An automatic document conveyance device (not shown) that supplies documents to the image forming apparatus 1A may also be provided at an upper portion of the image forming apparatus 1A.

As shown in FIG. 2, in the image forming apparatus 1A, the primary conveyance path 24 and the reverse conveyance path 20 constituting the conveyor 21, the fixing unit 30, and the like are formed as a conveyance part 200, and the conveyance part 200 can be pulled out of the apparatus main body 10. In this structure, when a jam such as a paper jam occurs in the reverse conveyance path 20 or the like, the conveyance part 200 is pulled out of the apparatus main body 10 so that the paper sheet can be removed.

<Example of the Control Function of the Image Forming Apparatus According to this Embodiment>

Figure 3:
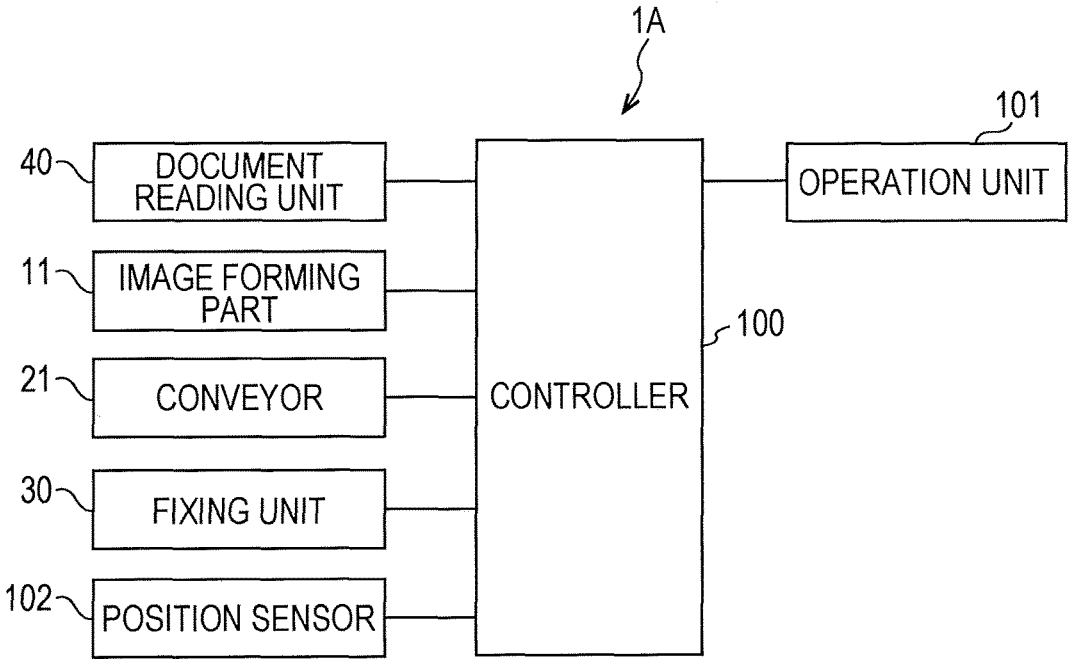
FIG. 3 is a functional block diagram showing an example of the control function of the image forming apparatus according to this embodiment.

FIG. 3 is a functional block diagram showing an example of the control function of the image forming apparatus according to this embodiment. The image forming apparatus 1A includes a controller 100 that performs a series of control processes to supply a paper sheet, form an image, and discharge the paper sheet. The controller 100 is an example of a control means. The controller 100 includes a microprocessor called a CPU or an MPU, and memories such as a RAM and a ROM as storage means.

The image forming apparatus 1A also includes an operation unit 101 through which various operations are performed, such as setting of paper on which images are to be formed, and setting of the number of images to be formed. The image forming apparatus 1A further includes a position sensor 102 that senses the position of a paper sheet in the main scanning direction.

Figure 4A:
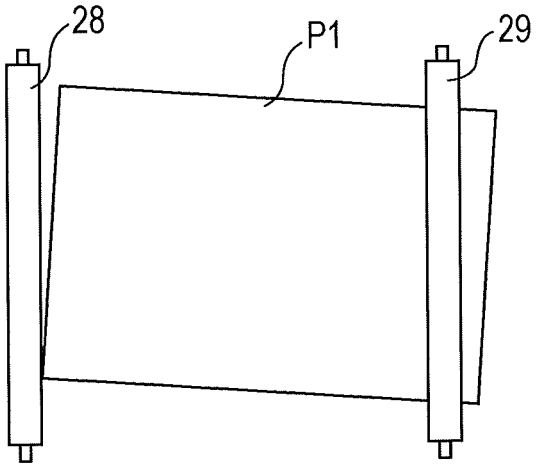
FIGS. 4A through 4C are diagrams for explaining an example of resist shaking.
Figure 4B:
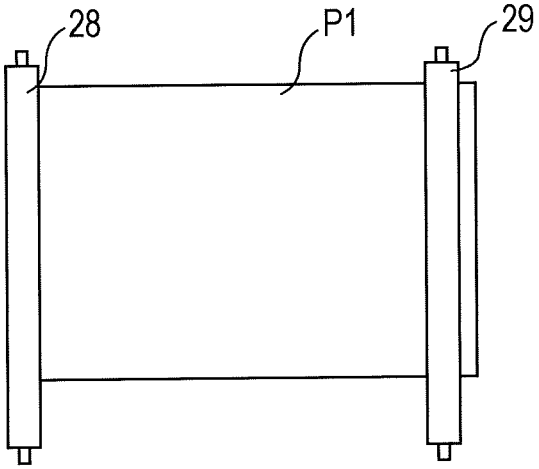
Figure 4C:
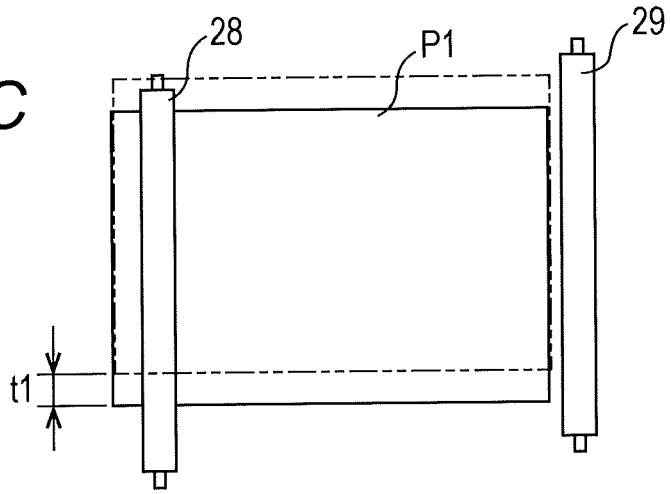

FIGS. 4A through 4C are diagrams for explaining an example of resist shaking. As shown in FIG. 4A, if a paper sheet tilted in the planar direction, which is a paper sheet P2 in this example, is conveyed by the loop rollers 29 while the resist rollers 28 are stopped, the top edge of the paper sheet P2 is brought into contact with the nip portion of the resist rollers 28. In this manner, the tilt of the paper sheet P2 is corrected, as shown in FIG. 4B.

When the controller 100 conducts resist shaking, the position of the paper sheet P2 is sensed by the position sensor 102, and a correction amount t1 for adjusting the position of the paper sheet P2 in the main scanning direction to the image formation position is determined in accordance with the position of the paper sheet P2 in the main scanning direction sensed by the position sensor 102. The correction amount t1 in the resist shaking is the amount of movement of the paper sheet P2 for adjusting the position of the paper sheet P2 in the width direction to the position of the image formation to be performed by the image forming part 11.

The conveyor 21 includes a drive mechanism (not shown) for moving the resist rollers 28 in the main scanning direction. The drive mechanism serves as a component related to resist shaking. The controller 100 moves the resist rollers 28 in the main scanning direction by the correction amount t1 based on the position of the paper sheet P2 in the main scanning direction sensed by the position sensor 102. In this manner, the position of the paper sheet P2 in the main scanning direction is adjusted to the image formation position, as shown in FIG. 4C.

<Example Operation of the Image Forming Apparatus According to this Embodiment>

FIGS. 5 through 9 are diagrams for explaining an example operation of the image forming apparatus according to this embodiment. Referring to these drawings, operation of the image forming apparatus according to this embodiment is described.

Figure 5:
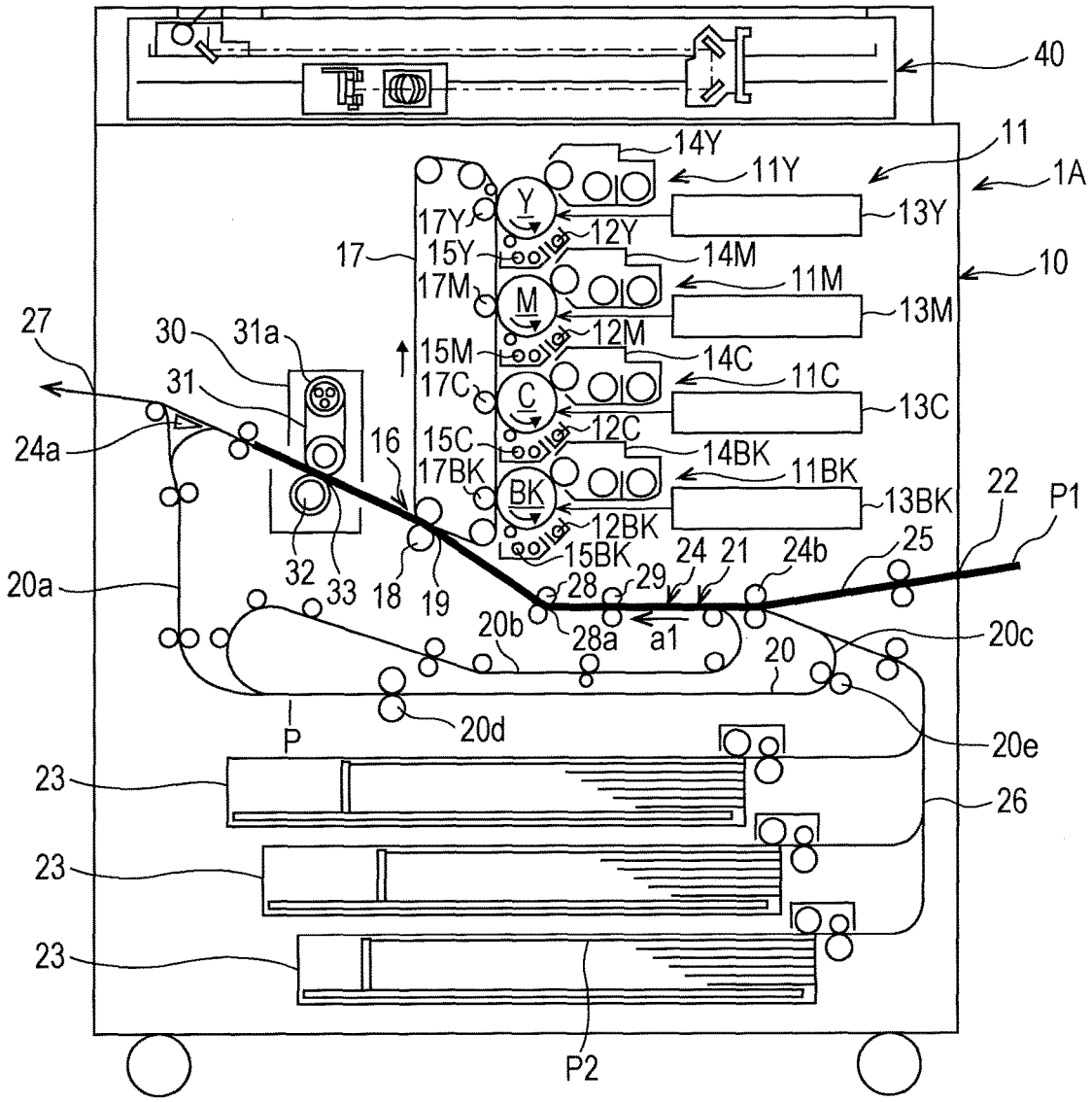
FIG. 5 is a diagram showing an example operation of the image forming apparatus according to this embodiment.

In a case where images are formed on both surfaces of a long paper sheet P1, the long paper sheet P1 is conveyed in the primary conveyance path 24, with a first surface of the long paper sheet P1 facing upward and facing the intermediate transfer belt 17. As shown in FIG. 5, the long paper sheet P1 being conveyed in the primary conveyance path 24 has an image transferred onto the first surface, which is the surface facing upward at the intermediate transfer belt 17, and the image is fixed by the fixing unit 30.

Figure 6:
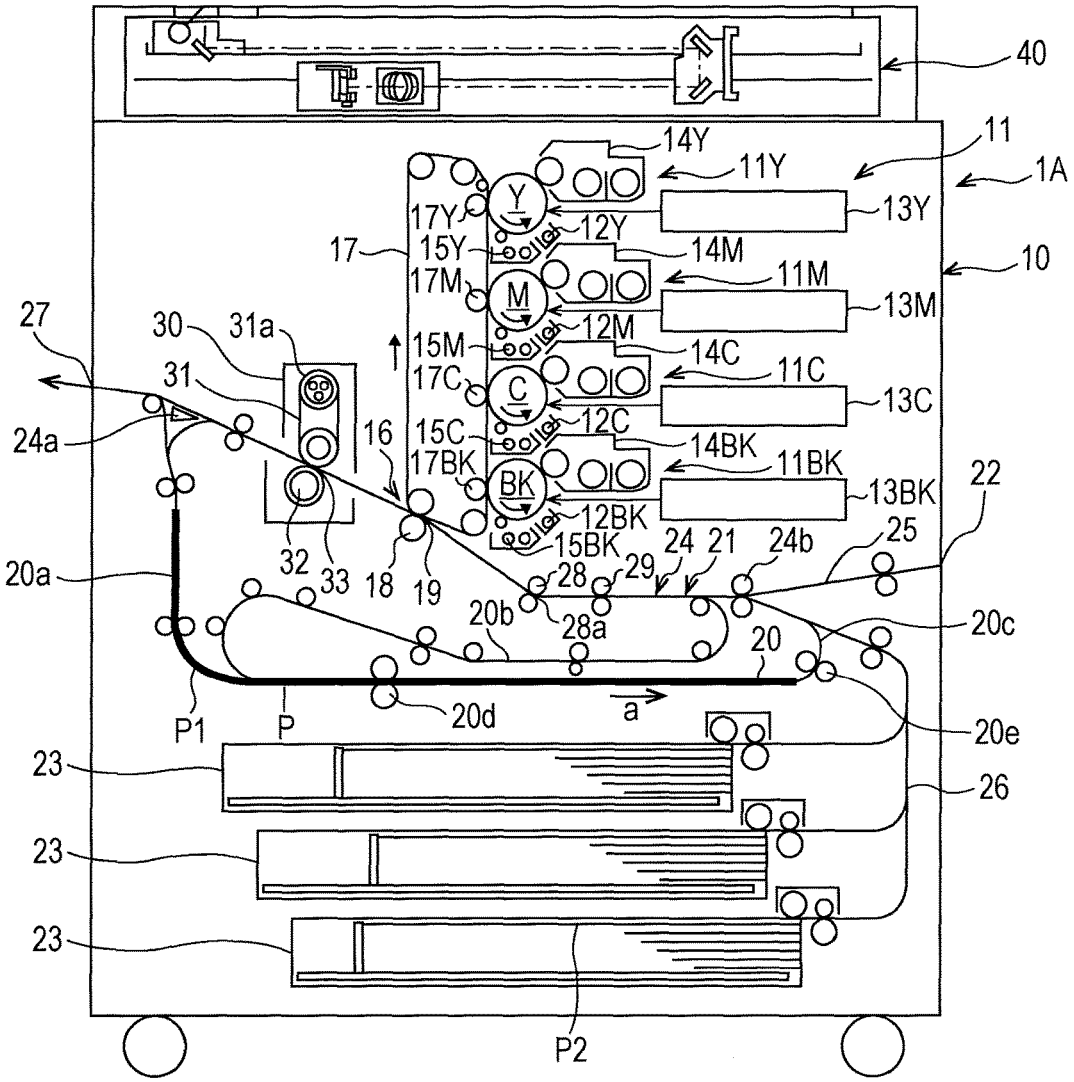
FIG. 6 is a diagram showing an example operation of the image forming apparatus according to this embodiment.

In the operation to form images on both surfaces of the long paper sheet P1, the conveyance path of the long paper sheet P1 being conveyed in the primary conveyance path 24 is switched to the reverse conveyance path 20 by the switching gate 24*a*. As a result, the long paper sheet P1 is conveyed from the primary conveyance path 24 to the reverse conveyance path 20, as shown in FIG. 6. As for a paper sheet P2 stored in a paper cassette 23, when the paper sheet P2 is conveyed to the reverse conveyance path 20, the bottom edge of the paper sheet P2 passes through the switchback point P before the top edge of the paper sheet P2 enters the connecting conveyance path 20*c* in the conveyance in the forward direction indicated by the arrow "a".

Figure 7:
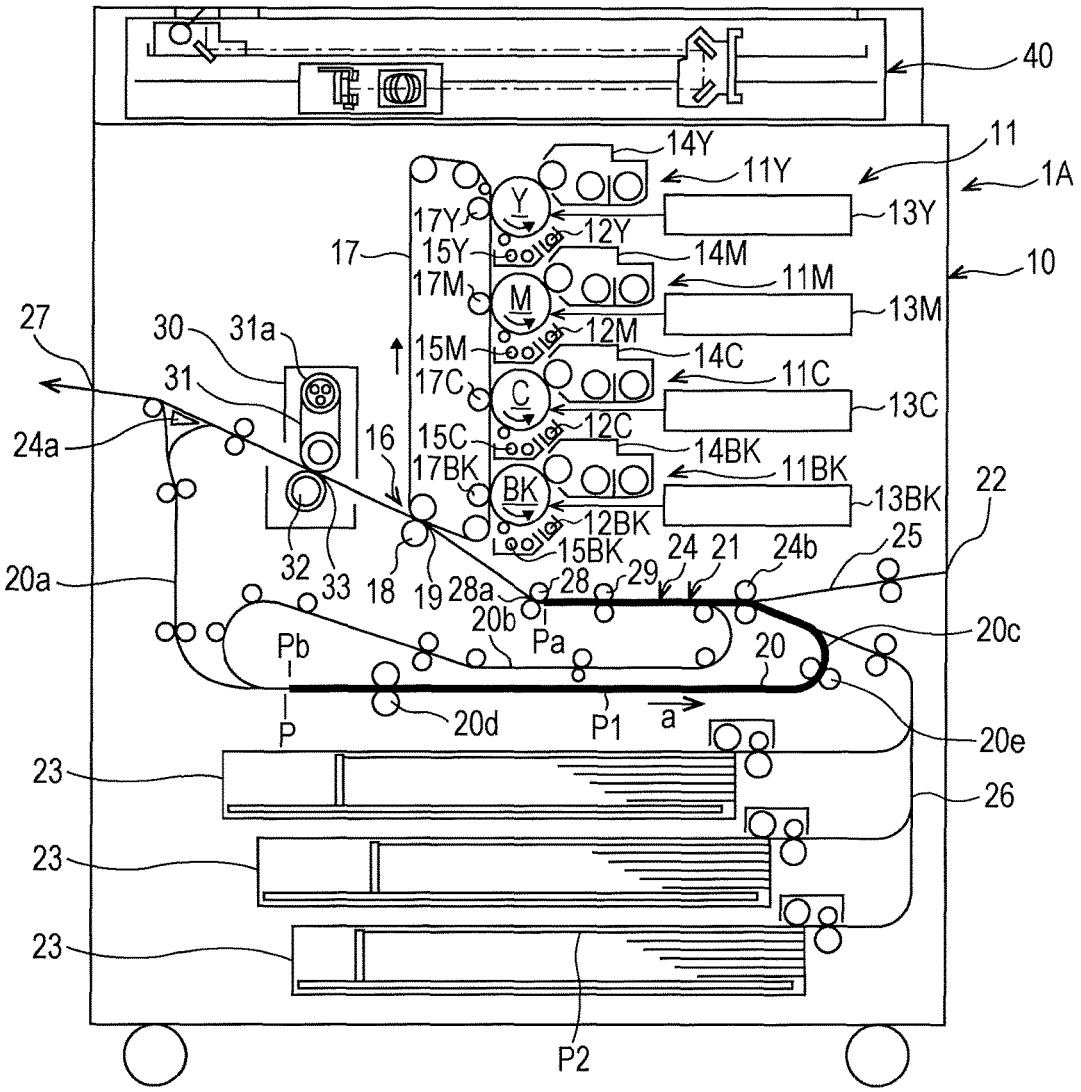
FIG. 7 is a diagram showing an example operation of the image forming apparatus according to this embodiment.

When the long paper sheet P1 is conveyed in the forward direction indicated by the arrow "a", an edge Pa of the long paper sheet P1 is the top edge in the conveyance direction, and an edge Pb of the long paper sheet P1 is the bottom edge in the conveyance direction. When the long paper sheet P1 is conveyed in the reverse conveyance path 20 in the forward direction indicated by the arrow "a", the edge Pa as the top edge in the conveyance direction passes through the connecting conveyance path 20*c*, and enters the primary conveyance path 24. When the edge Pb as the bottom edge in the conveyance direction passes through the switchback point P, as shown in FIG. 7, the conveyance is suspended.

As the direction of rotation of the conveyance rollers 20*d* is reversed, the direction of conveyance of the long paper sheet P1 in the reverse conveyance path 20 is switched from the forward direction indicated by the arrow "a" to the backward direction indicated by the arrow "b". When the long paper sheet P1 is conveyed in the backward direction indicated by the arrow "b", the edge Pb of the long paper sheet P1 is the top edge in the conveyance direction, and the edge Pa of the long paper sheet P1 is the bottom edge in the conveyance direction.

Figure 8:
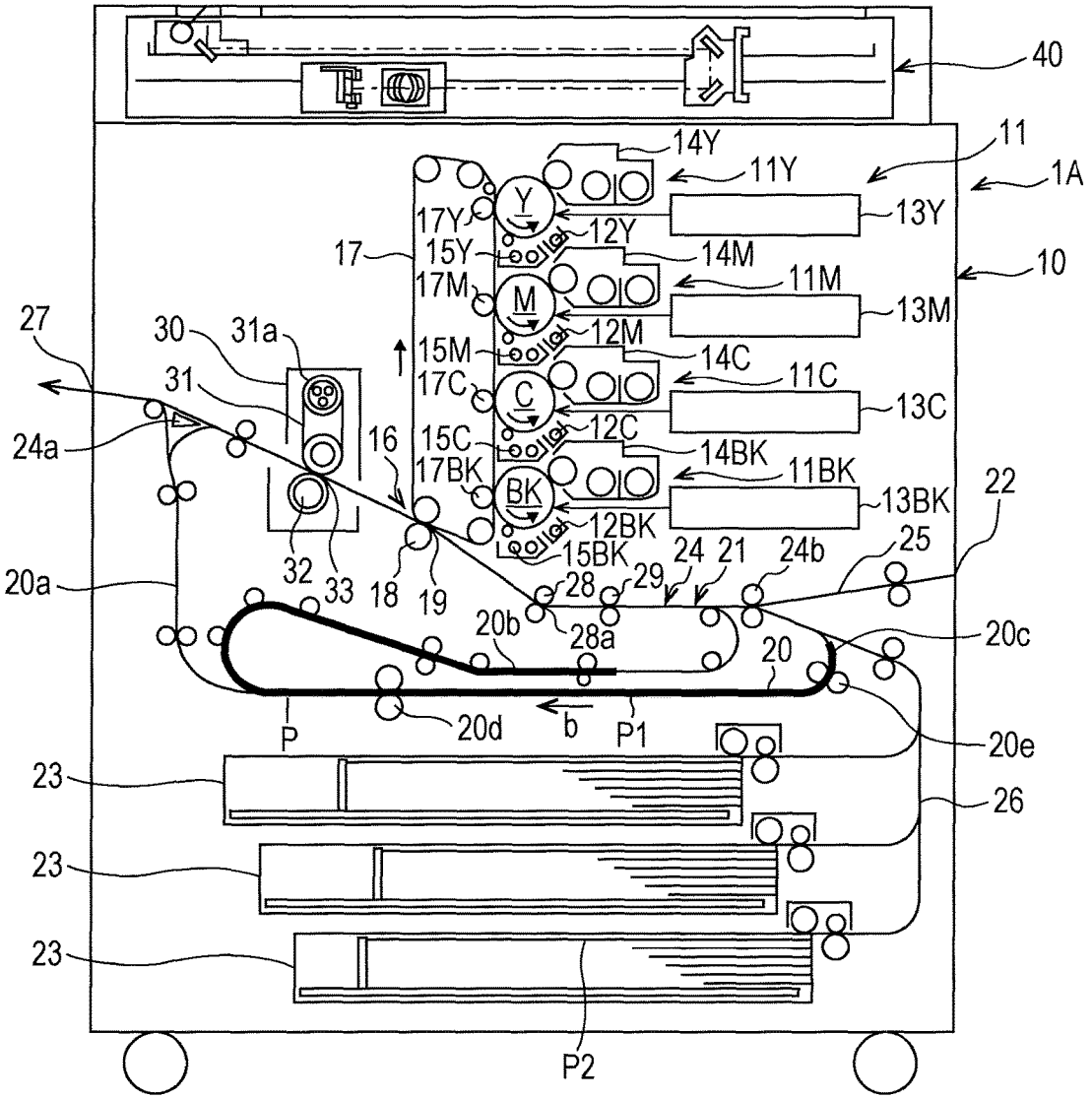
FIG. 8 is a diagram showing an example operation of the image forming apparatus according to this embodiment.
Figure 9:
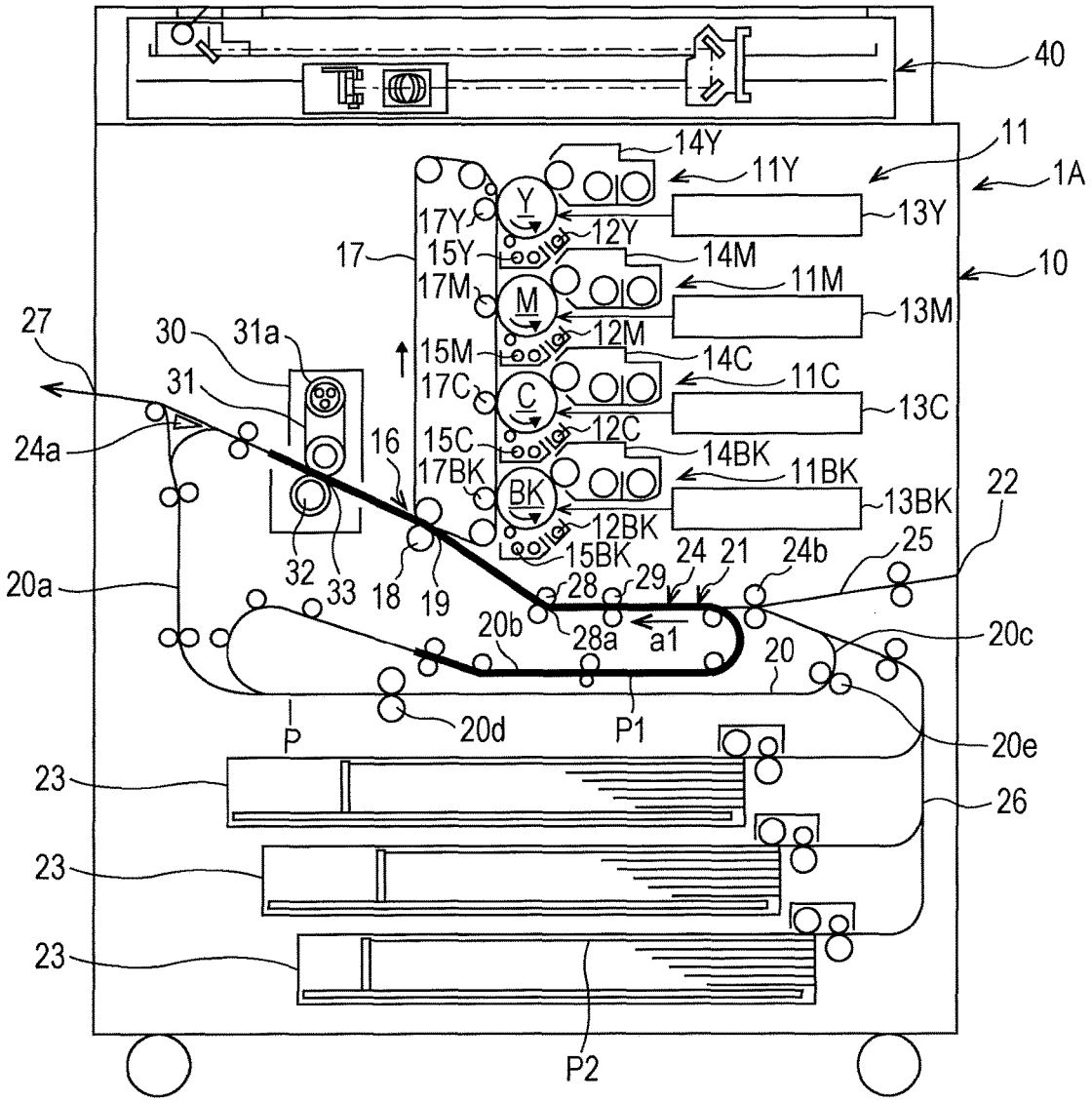
FIG. 9 is a diagram showing an example operation of the image forming apparatus according to this embodiment.

In the conveyance in the forward direction indicated by the arrow "a", when the long paper sheet P1 is conveyed in the backward direction indicated by the arrow "b" after the edge Pb of the long paper sheet P1 passes through the switchback point P, the long paper sheet P1 is conveyed to the second return conveyance path 20*b* as shown in FIG. 8. The long paper sheet P1 being conveyed in the second return conveyance path 20*b* is then returned to the primary conveyance path 24, as shown in FIG. 9.

The long paper sheet P1 conveyed from the reverse conveyance path 20 to the primary conveyance path 24 in this manner has the first surface as the image formation surface facing downward. An image is then transferred onto a second surface facing upward, and the image is fixed by the fixing unit 30.

<Example Function Effects of the Image Forming Apparatus According to this Embodiment>

In the image forming apparatus 1A according to this embodiment, when a long paper sheet P1 having a greater length than a conventional reverse conveyance path is conveyed to the reverse conveyance path 20, the long paper sheet P1 enters the primary conveyance path 24 through the connecting conveyance path 20*c*. In this structure, part of the primary conveyance path 24 can be used as the reverse conveyance path 20, and the edge Pb that is the bottom edge of the long paper sheet P1 being conveyed in the forward direction indicated by the arrow "a" can be conveyed past the switchback point. Thus, the long paper sheet P1 can be reversed, and images can be formed on both surfaces of the long paper sheet P1.

In a case where the reverse conveyance path is made longer so that a long paper sheet P1 can be reversed, the reverse conveyance path may be extended outside the conveyance part 200 shown in FIG. 2. In such a structure, conveyance may be suspended if a long paper sheet P1 is stuck at a position between the reverse conveyance path inside the conveyance part 200 and the reverse conveyance path extended outside the conveyance part 200.

If the conveyance part 200 is to be pulled out while a long paper sheet P1 remains at the position between the inside and the outside of the conveyance part 200, the long paper sheet P1 may serve as a resistance and hinder the conveyance part 200 from being pulled out. Also, the long paper sheet P1 may be cut at an intended portion, and it may become difficult to remove the long paper sheet P1.

In the image forming apparatus 1A of this embodiment, on the other hand, the reverse conveyance path 20 is connected to the primary conveyance path 24 with the connecting conveyance path 20*c*, so that the reverse conveyance path 20 can be extended inside the conveyance part 200. With this, even if a long paper sheet P1 is jammed in the reverse conveyance path 20, the long paper sheet P1 does not remain at the position between the inside and the outside of the conveyance part 200. Thus, the conveyance part 200 can be pulled out, and the long paper sheet P1 can be removed.

<Modifications of the Image Forming Apparatus According to this Embodiment>

Figure 10:
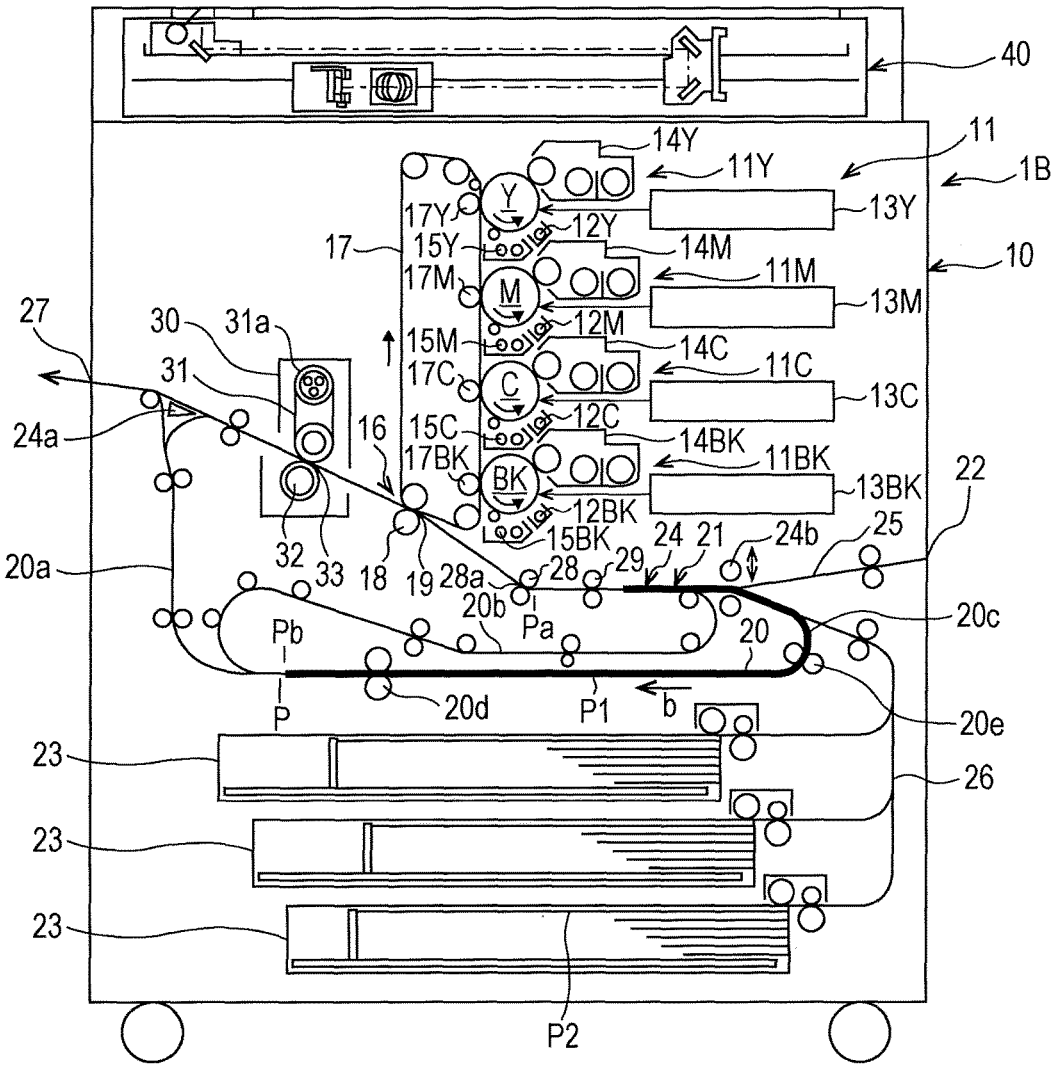
FIG. 10 is a diagram showing an example structure of a modification of the image forming apparatus according to this embodiment.

FIG. 10 is a diagram showing an example structure of a modification of the image forming apparatus according to this embodiment. In an image forming apparatus 1B of this modification, the guide rollers 24*b* located in a region through which a long paper sheet P1 passes in a case where part of the primary conveyance path 24 serves as the reverse conveyance path 20 can be retracted from the primary conveyance path 24 at a predetermined timing.

That is, in a process of conveying a long paper sheet P1 in the reverse conveyance path 20 in the forward direction indicated by the arrow "a", the guide rollers 24*b* are moved to the conveyance guide position in contact with the long paper sheet P1 being conveyed in the primary conveyance path 24.

When the long paper sheet P1 is conveyed in the reverse conveyance path 20 in the forward direction indicated by the arrow "a", the edge Pa as the top edge in the conveyance direction passes through the connecting conveyance path 20*c*, and enters the primary conveyance path 24. The long paper sheet P1 being conveyed in the primary conveyance path 24 is conveyed in the forward direction indicated by the arrow "a".

With this, the long paper sheet P1 is brought into contact with the guide rollers 24*b*, so that the guide rollers 24*b* rotate following the long paper sheet P1 being conveyed, and function as a guide.

On the other hand, in a process of conveying a long paper sheet P1 in the reverse conveyance path 20 in the backward direction indicated by the arrow "b", the guide rollers 24*b* are moved to the retraction position not in contact with the long paper sheet P1 being conveyed in the primary conveyance path 24, as shown in FIG. 10.

With this, in the process of conveying a long paper sheet P1 in the reverse conveyance path 20 in the backward direction indicated by the arrow "b", the guide rollers 24*b* are separated from the long paper sheet P1 and are prevented from putting a load on the long paper sheet P1 being conveyed. Thus, the paper feed resistance can be reduced.

Figure 11:
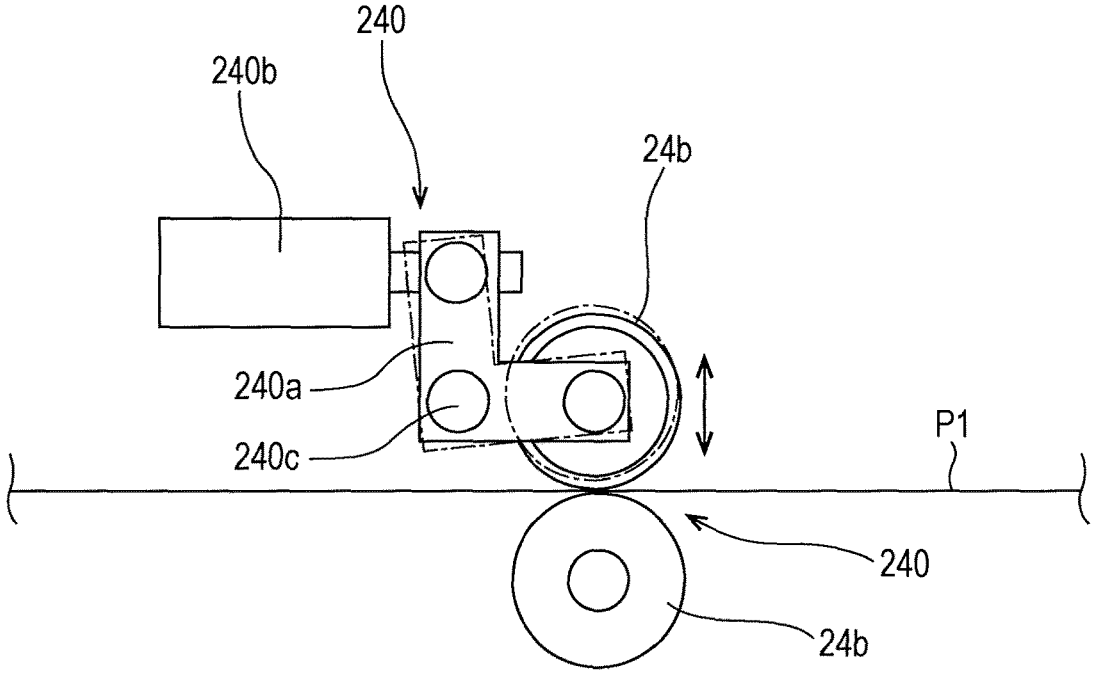
FIG. 11 is a diagram showing an example structure of a guide roller retractor.

FIG. 11 is a diagram showing an example structure of the guide roller retractor. A retractor 240 in this example includes a supporting member 240*a* that moves the pair of guide rollers 24*b* in such directions that the guide rollers 24*b* separate from each other, and an actuator 240*b*. In this example, the retractor 240 causes the supporting member 240*a* to rotate about a shaft 240*c* by virtue of operation of the actuator 240*b*, so that the pair of guide rollers 24*b* push each other and separate from each other.

In an operation to form images on the front and the back of a long paper sheet P1, the controller 100 shown in FIG. 3 controls the actuator 240*b* in the process of conveying the long paper sheet P1 in the reverse conveyance path 20 in the forward direction indicated by the arrow "a", so that the guide rollers 24*b* are moved to the conveyance guide position indicated by a solid line in FIG. 11. In the process of conveying the long paper sheet P1 in the reverse conveyance path 20 in the backward direction indicated by the arrow "b", the controller 100 controls the actuator 240*b*, so that the guide rollers 24*b* are moved to the retraction position indicated by a dot-and-dash line in FIG. 11.

Figure 12:
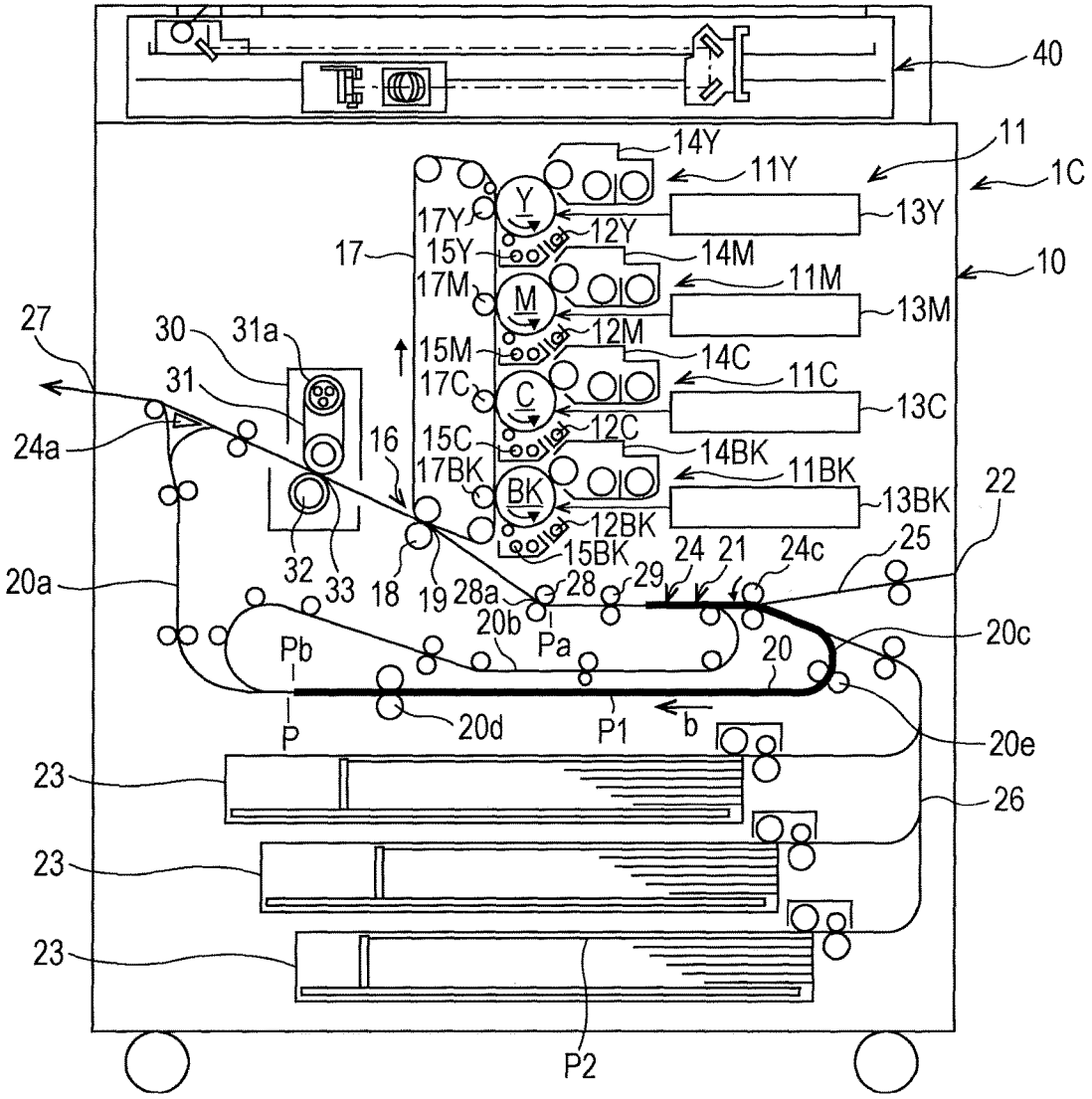
FIG. 12 is a diagram showing an example structure of another modification of the image forming apparatus according to this embodiment.

FIG. 12 is a diagram showing an example structure of another modification of the image forming apparatus according to this embodiment. An image forming apparatus 1C of this modification includes conveyance rollers 24*c* in a region through which a long paper sheet P1 passes in a case where part of the primary conveyance path 24 serves as the reverse conveyance path 20.

The conveyance rollers 24*c* are an example of a conveyance member. The conveyance rollers 24*c* are driven by a motor (not shown), and convey a long paper sheet P1 both in the forward direction and in the backward direction. In the process of conveying a long paper sheet P1 in the reverse conveyance path 20 in the backward direction indicated by the arrow "b", the conveyance rollers 24*c* are synchronized with the conveyance rollers 20*d* and are rotated in the direction in which the long paper sheet P1 is conveyed in the backward direction indicated by the arrow "b", as shown in FIG. 12.

With this, in the process of conveying a long paper sheet P1 in the reverse conveyance path 20 in the backward direction indicated by the arrow "b", the side of the edge Pb of the long paper sheet P1, which is the top edge in the conveyance direction, can be conveyed by the conveyance rollers 20*d*, and the side of the other edge Pa, which is the bottom edge in the conveyance direction, can be conveyed by the conveyance rollers 24*c*. Thus, an increase in the paper feed resistance can be prevented, and movement of the long paper sheet P1 can be stabilized.

Figure 13A:
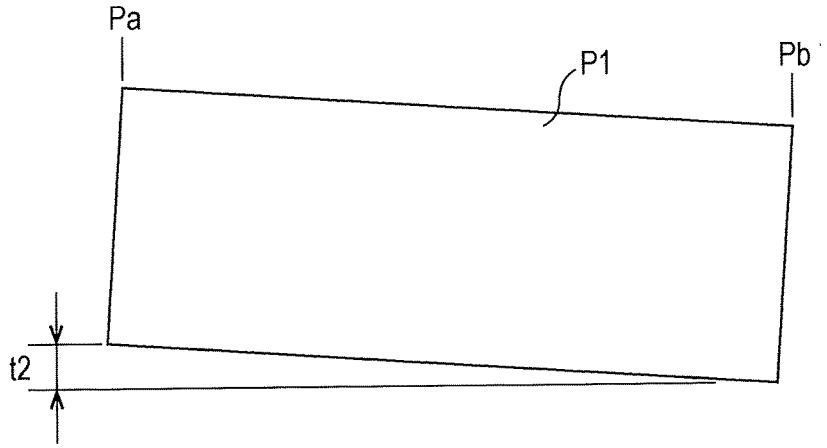
FIGS. 13A through 13C are diagrams for explaining a problem that may occur when a long paper sheet is used.
Figure 13B:
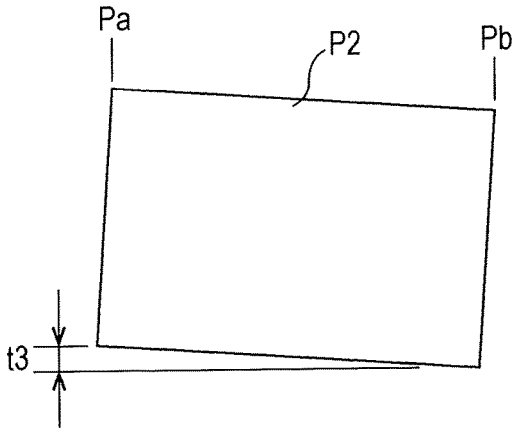
Figure 13C:
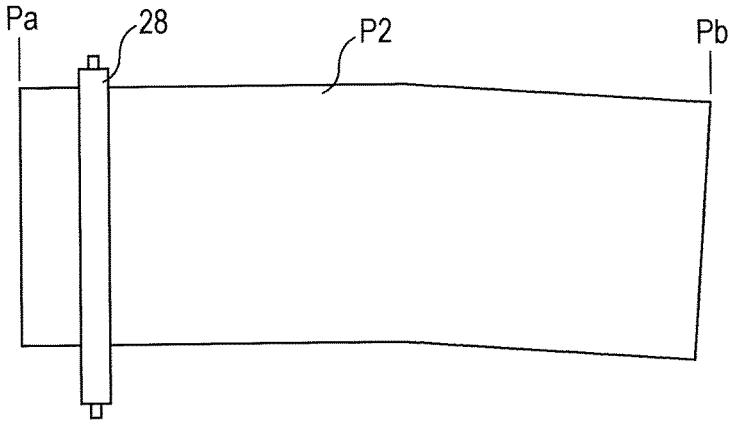

FIGS. 13A through 13C are diagrams for explaining a problem that may occur when a long paper sheet is used. A long paper sheet P1 is longer in the conveyance direction than a paper sheet P2 that can be stored in a paper cassette 23. Therefore, as shown in FIG. 13A, if the long paper sheet P1 being conveyed in the primary conveyance path 24 is tilted in the planar direction, the difference t2 in the position in the main scanning direction between the edge Pa and the other edge Pb is larger than the difference t3 in the case of a paper sheet P2 shown in FIG. 13B. As a result, image shifting may occur during an operation to form images on both surfaces of the long paper sheet P1.

To counter this, in an operation to form images on both surfaces of a long paper sheet P1, the above described resist shaking may be performed so that the image formation positions on the front and the back are adjusted to each other.

However, in the case of a long paper sheet P1, even if position adjustment is performed through resist shaking performed on the side of the edge Pa of the long paper sheet P1, the side of the other edge Pb may not follow the movement caused by the shaking performed on the side the edge Pa of the long paper sheet P1, as shown in FIG. 13C. Therefore, in a case where part of the primary conveyance path 24 serves as the reverse conveyance path 20 so as to reverse a long paper sheet P1, resist shaking is performed at both the edge Pa and the other edge Pb of the long paper sheet P1.

Figure 14A:
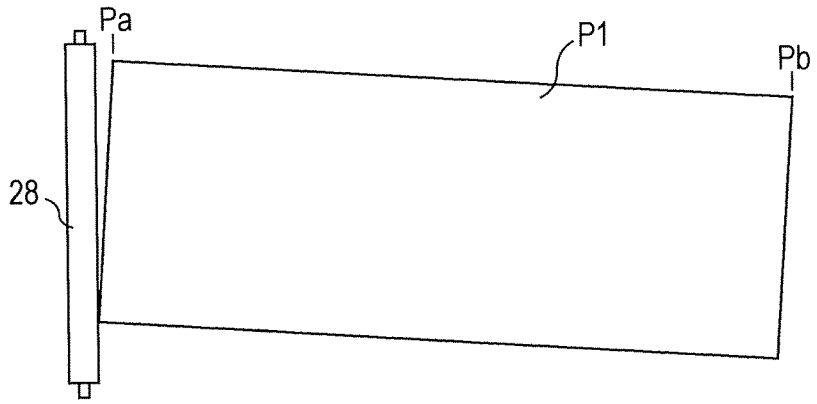
FIGS. 14A through 14D are diagrams for explaining an example resist shaking operation according to this embodiment.

FIGS. 14A through 14D and FIGS. 15A through 15D are diagrams for explaining examples of resist shaking according to this embodiment, and show examples of shifting of a long paper sheet P1 in a case where resist shaking is performed on the long paper sheet P1. When a long paper sheet P1 is conveyed in the reverse conveyance path 20 in the forward direction indicated by the arrow "a", as shown in FIG. 7, the edge Pa as the top edge in the conveyance direction passes through the connecting conveyance path 20*c*, and enters the primary conveyance path 24. The long paper sheet P1 is then conveyed to such a position that the edge Pa of the long paper sheet P1 reaches the resist rollers 28, as shown in FIG. 14A, and resist shaking is performed.

Figure 14B:
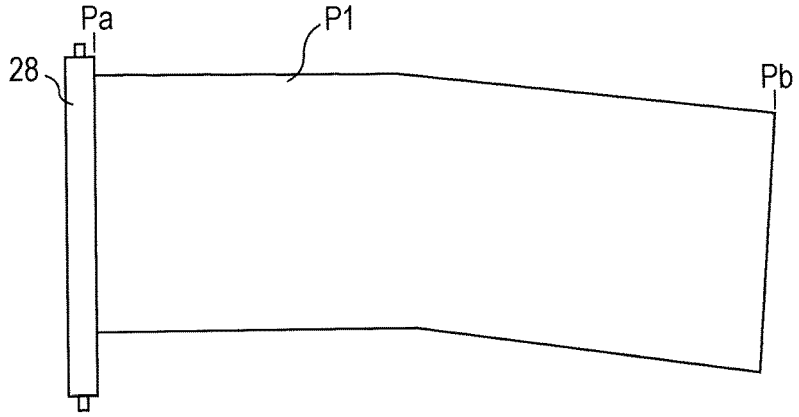

In the resist shaking on the side of the edge Pa of the long paper sheet P1, the long paper sheet P1 is conveyed while the resist rollers 28 are stopped, and the edge Pa of the long paper sheet P1 is brought into contact with the resist rollers 28, so that the tilt in the direction along the surfaces of the long paper sheet P1 is corrected on the side of the edge Pa of the long paper sheet P1, as shown in FIG. 14B.

Figure 14C:
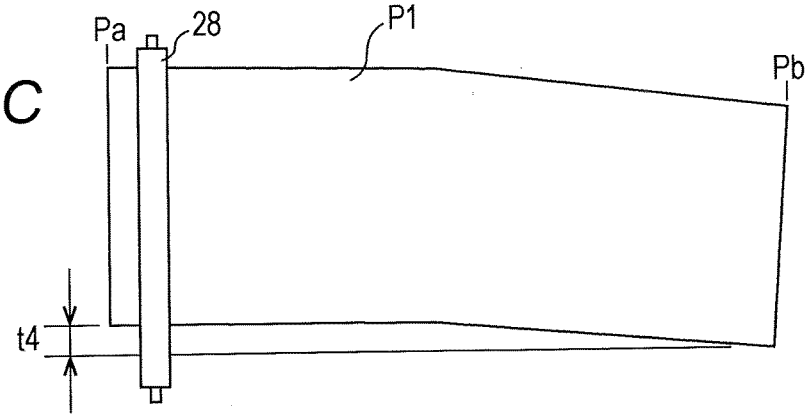

The controller 100 senses the position of the long paper sheet P1 in the main scanning direction on the side of the edge Pa with the position sensor 102, and, in accordance with the position of the long paper sheet P1 in the main scanning direction sensed with the position sensor 102, the controller 100 determines a first correction amount t4 for adjusting the position of the long paper sheet P1 in the width direction to the image formation position, as shown in FIG. 14C. If the deviation of the position of the long paper sheet P1 in the main scanning direction on the side of the edge Pa sensed with the position sensor 102 is zero, it is determined that the tilt of the long paper sheet P1 has been corrected, and the position of the long paper sheet P1 in the main scanning direction has been adjusted to the image formation position. Therefore, any correction in the main scanning direction is not performed.

Figure 14D:
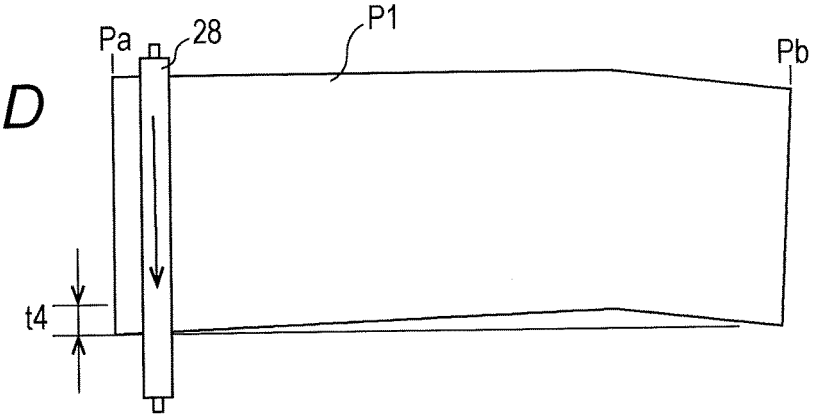

The resist rollers 28 are then moved in the main scanning direction of the long paper sheet P1 in accordance with the first correction amount t4, so that the position of the long paper sheet P1 in the main scanning direction is corrected and is returned to a predetermined position on the side of the edge Pa, as shown in FIG. 14D. Thus, the tilt of the entire long paper sheet P1 is corrected.

Figure 15A:
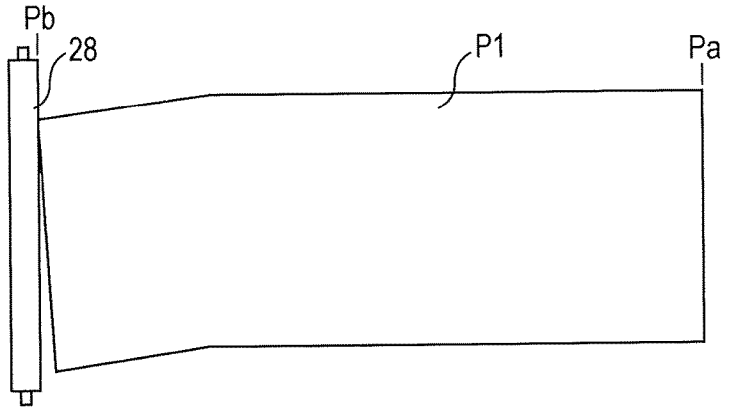
FIGS. 15A through 15D are diagrams for explaining an example resist shaking operation according to this embodiment.

A long paper sheet P1 being conveyed in the reverse conveyance path 20 in the backward direction indicated by the arrow "b" as shown in FIG. 8 is returned from the second return conveyance path 20*b* to the primary conveyance path 24. The long paper sheet P1 is then conveyed to such a position that the other edge Pb of the long paper sheet P1 reaches the resist rollers 28, as shown in FIG. 15A, and resist shaking is performed.

Figure 15B:
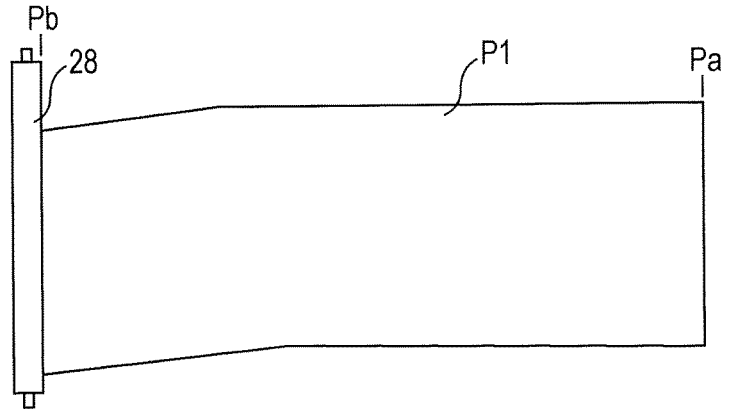

In the resist shaking on the side of the other edge Pb of the long paper sheet P1, the long paper sheet P1 is conveyed while the resist rollers 28 are stopped, and the other edge Pb of the long paper sheet P1 is brought into contact with the resist rollers 28, so that the tilt in the direction along the surfaces of the long paper sheet P1 is corrected on the side of the other edge Pb of the long paper sheet P1, as shown in FIG. 15B.

Figure 15C:
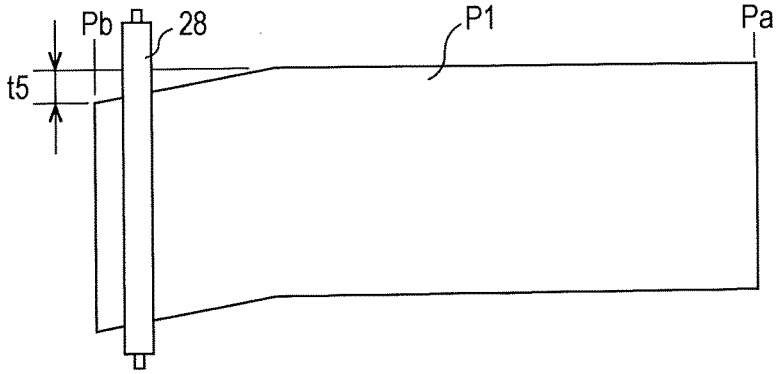
Figure 15D:
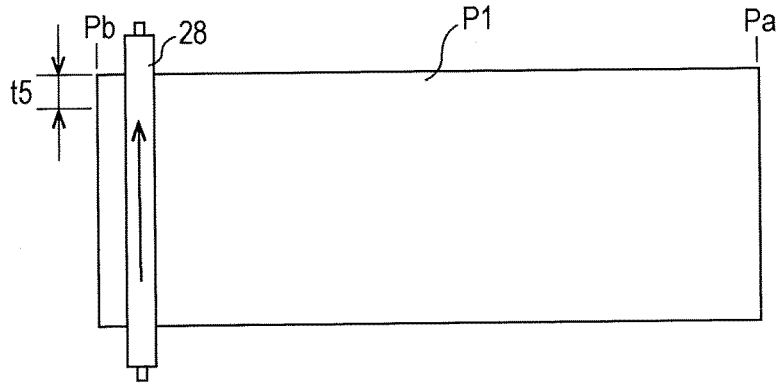

The controller 100 senses the position of the long paper sheet P1 in the main scanning direction on the side of the other edge Pb with the position sensor 102, and, in accordance with the position of the long paper sheet P1 in the main scanning direction sensed with the position sensor 102, the controller 100 determines a second correction amount t5 for adjusting the position of the long paper sheet P1 in the width direction to the image formation position, as shown in FIG. 15C. In the resist shaking on the side of the other edge Pb of the long paper sheet P1, the second correction amount t5 may be determined in accordance with the first correction amount t4 determined at the time of the resist shaking performed on the side of the edge Pa.

The resist rollers 28 are then moved in the main scanning direction of the long paper sheet P1 in accordance with the second correction amount t5, so that the position of the long paper sheet P1 in the main scanning direction is corrected on the side of the other edge Pb, as shown in FIG. 15C.

Accordingly, after an image is formed on the front surface as the first surface of the long paper sheet P1, in the process reversing the long paper sheet P1, resist shaking can be performed both at one edge and the other edge of the long paper sheet P1, and the image formation positions in the main scanning direction can be adjusted to each other on the front and the back of the long paper sheet P1. Thus, curved images can be avoided, and defects such as wrinkles on a long paper sheet P1 can be prevented.

In the structure that conveys a long paper sheet P1 in the reverse conveyance path 20 with the conveyance rollers 20*d*, if resist shaking is performed on the side of the edge Pa of the long paper sheet P1 being conveyed from the reverse conveyance path 20 to the primary conveyance path 24 via the connecting conveyance path 20*c*, the long paper sheet P1 cannot be conveyed in the backward direction indicated by the arrow "b" once the other edge Pb of the long paper sheet P1 is conveyed past the conveyance rollers 20*d*. To counter this, the reverse conveyance path 20 may include conveyance rollers 20*d* in the direction of conveyance of the long paper sheet P1.

Figure 16:
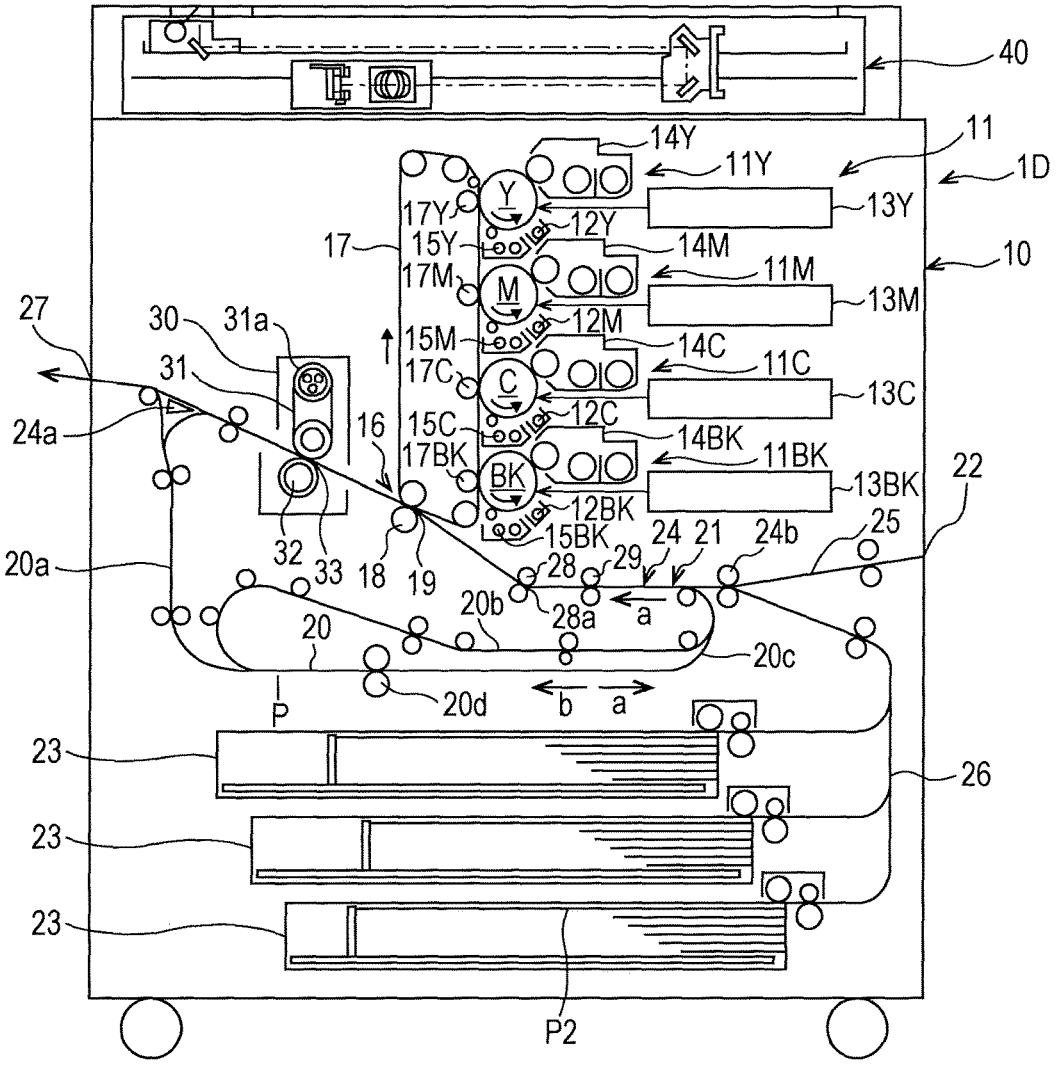
FIG. 16 is a diagram showing an example structure of yet another modification of the image forming apparatus according to this embodiment.

FIG. 16 is a diagram showing an example structure of yet another modification of the image forming apparatus according to this embodiment. In an image forming apparatus 1D of yet another modification, the reverse conveyance path 20 joins the second return conveyance path 20*b* in the connecting conveyance path 20*c*. With this, the connecting conveyance path 20*c* and the second return conveyance path 20*b* can share the existing guide panels and guide rollers.

Figure 17:
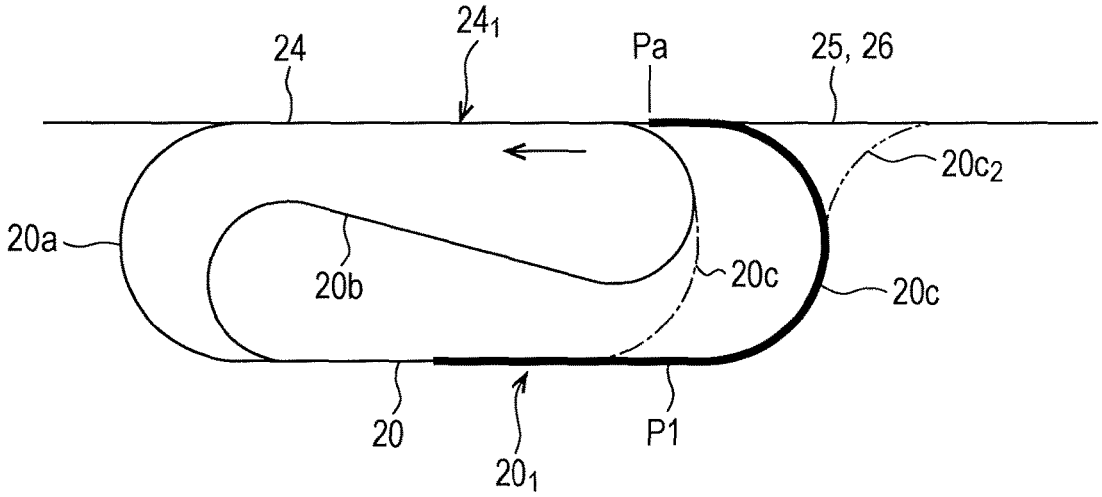
FIG. 17 is a diagram showing an example structure of still another modification of the image forming apparatus according to this embodiment.

FIG. 17 is a diagram showing an example structure of still another modification of the image forming apparatus according to this embodiment. A long paper sheet P1 that has not been reversed and is being conveyed in a second conveyance path $20_1$ that includes the reverse conveyance path 20 is sent to a first conveyance path $24_1$ that includes the primary conveyance path 24, starting from the edge Pa as the top edge in the conveyance direction. The connecting conveyance path 20*c* described above with reference to FIG. 1 or the connecting conveyance path 20*c* that has been described above with reference to FIG. 16 and is indicated by a dot-and-dash line in FIG. 17 is provided so that, after the top edge of the long paper sheet P1 enters the first conveyance path $24_1$, the long paper sheet P1 moves toward the downstream side of the first conveyance path $24_1$ in the direction of conveyance of the long paper sheet P1 indicated by an arrow. Alternatively, a connecting conveyance path $20c_2$ indicated by a double-dot-and-dash line in FIG. 17 may be provided so that the long paper sheet P1 moves toward the upstream side of the first conveyance path $24_1$.

FIGS. 18A through 18G are diagrams showing example structures of other modifications of the image forming apparatus according to this embodiment, and indicate the forms of joining of the respective conveyance paths.

Figure 18A:
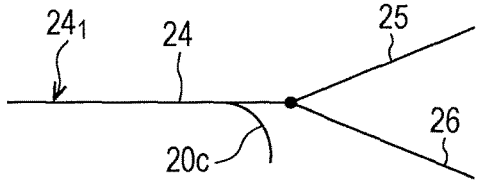
FIGS. 18A through 18G are diagrams showing example structures of other modifications of the image forming apparatus according to this embodiment.
Figure 18B:
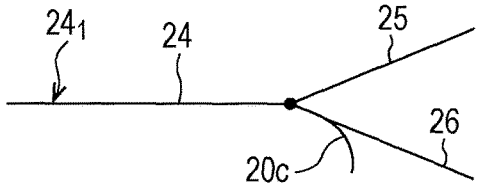
Figure 18C:
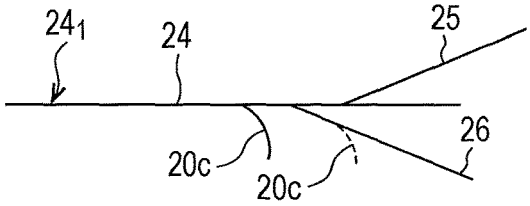

In the first conveyance path $24_1$ in the example shown in FIG. 18A, the external paper conveyance path 25 and the paper conveyance path 26 join the primary conveyance path 24, and the connecting conveyance path 20*c* also joins the primary conveyance path 24. In the first conveyance path $24_1$ in the example shown in FIG. 18B, the external paper conveyance path 25 and the paper conveyance path 26 join the primary conveyance path 24, and the connecting conveyance path 20*c* joins the paper conveyance path 26. In the first conveyance path $24_1$ in the example shown in FIG. 18C, the external paper conveyance path 25 and the paper conveyance path 26 join the primary conveyance path 24 halfway, and the connecting conveyance path 20*c* joins the primary conveyance path 24, as indicated by a solid line in FIG. 18C. Alternatively, the connecting conveyance path 20*c* joins the paper conveyance path 26, as indicated by a dashed line in FIG. 18C.

Figure 18D:
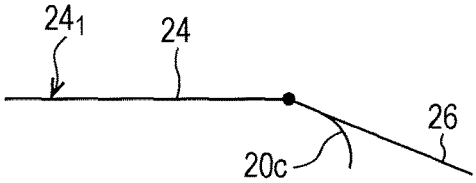
Figure 18E:
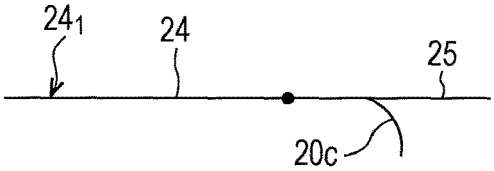

In the first conveyance path $24_1$ in the example shown in FIG. 18D, the paper conveyance path 26 joins the primary conveyance path 24, and the connecting conveyance path 20*c* joins the paper conveyance path 26. In the first conveyance path $24_1$ in the example shown in FIG. 18E, the external paper conveyance path 25 joins the primary conveyance path 24, and the connecting conveyance path 20*c* joins the external paper conveyance path 25.

Figure 18F:
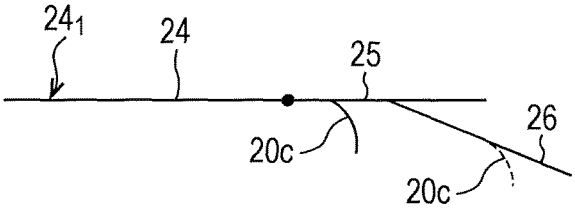

In the first conveyance path $24_1$ in the example shown in FIG. 18F, the external paper conveyance path 25 joins the primary conveyance path 24, and the paper conveyance path 26 joins the external paper conveyance path 25. Further, the connecting conveyance path 20*c* joins the external paper conveyance path 25, as indicated by a solid line in FIG. 18F. Alternatively, the connecting conveyance path 20*c* joins the paper conveyance path 26, as indicated by a dashed line in FIG. 18F.

Figure 18G:
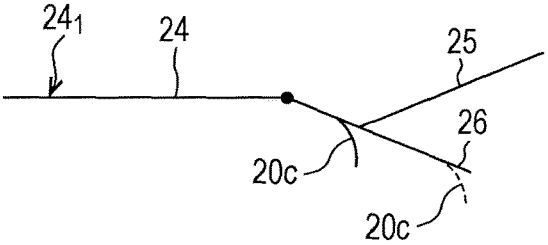

In the first conveyance path $24_1$ in the example shown in FIG. 18G, the paper conveyance path 26 joins the primary conveyance path 24, and the external paper conveyance path 25 joins the paper conveyance path 26. Further, the connecting conveyance path 20*c* joins the paper conveyance path 26 on the downstream side of the external paper conveyance path 25, as indicated by a solid line in FIG. 18G. Alternatively, the connecting conveyance path 20*c* joins the paper conveyance path 26 on the upstream side of the external paper conveyance path 25, as indicated by a dashed line in FIG. 18G.

As described above, at least either the external paper conveyance path 25 or the paper conveyance path 26 should join the primary conveyance path 24. The external paper conveyance path 25 may join the primary conveyance path 24 after joining the paper conveyance path 26, and the paper conveyance path 26 may join the primary conveyance path 24 after joining the external paper conveyance path 25. Further, the connecting conveyance path 20*c* may join not only the primary conveyance path 24 but also the external paper conveyance path 25 or the paper conveyance path 26, and the connecting conveyance path 20*c* should join at least one path among the primary conveyance path 24, the external paper conveyance path 25, and the paper conveyance path 26.

Figure 19:
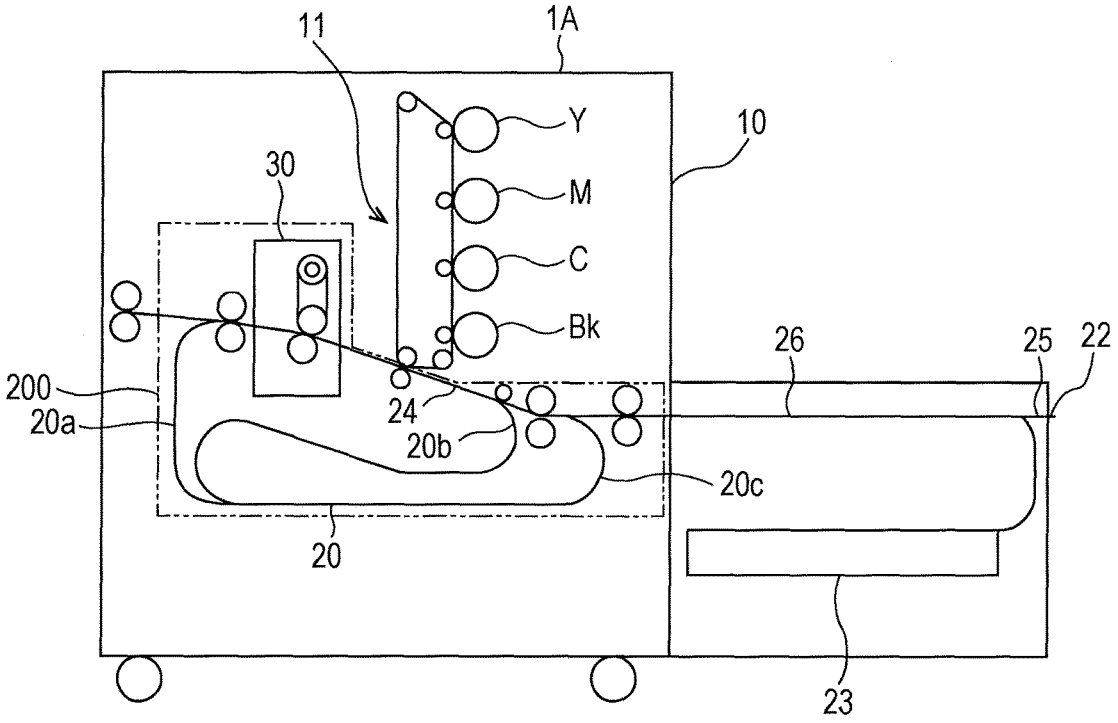
FIG. 19 is a diagram showing an example structure of yet another modification of the image forming apparatus according to this embodiment.

FIG. 19 is a diagram showing an example structure of yet another modification of the image forming apparatus according to this embodiment. The paper cassettes 23 are not necessarily provided at a lower portion of the apparatus main body 10, but may be provided on one side of the apparatus main body 10. Further, the external paper feed port 22 and the external paper conveyance path 25 leading to the external paper feed port 22 are not necessarily provided on one side of the apparatus main body 10, but may be provided on one side of a paper cassette 23.

The present invention is applied to an image forming apparatus that forms an image by transferring and fixing a toner image onto a long paper sheet.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image forming part that forms an image on a paper sheet;

a first conveyance path that conveys the paper sheet on which the image is formed by the image forming part, the first conveyance path including at least a primary conveyance path;

a second conveyance path that reverses the paper sheet, the second conveyance path including at least a reverse conveyance path;

a connecting conveyance path that connects the second conveyance path to the first conveyance path, and, before reversal at a time of conveyance to the second conveyance path, sends the paper sheet to the first conveyance path, starting from one edge of the paper sheet, the one edge being a top edge in a conveyance direction; and a return conveyance path that connects the second conveyance path to the first conveyance path, and, after the reversal at a time of conveyance to the second conveyance path, sends the paper sheet to the first conveyance path, starting from the other edge of the paper sheet, the other edge being a top edge in a conveyance direction.

2. The image forming apparatus according to claim 1, wherein a paper sheet having a length equal to or smaller than a first length that fits in a paper cassette, and a long paper sheet having a greater length than the first length can be conveyed, and the paper sheet to be conveyed to the connecting conveyance path is the long paper sheet.

3. The image forming apparatus according to claim 1, wherein the return conveyance path and the connecting conveyance path join each other.

4. The image forming apparatus according to claim 1, wherein, on an upstream side of the primary conveyance path in a direction of conveyance of a paper sheet having a length equal to or smaller than a first length that fits in a paper cassette and a long paper sheet having a greater length than the first length, a paper conveyance path that conveys the paper sheet from the paper cassette, and an external paper conveyance path that conveys one of the paper sheet and the long paper sheet from outside both join the primary conveyance path.

5. The image forming apparatus according to claim 4, wherein the connecting conveyance path joins one of the paper conveyance path and the external paper conveyance path.

6. The image forming apparatus according to claim 1, wherein, on an upstream side of the primary conveyance path in a direction of conveyance of a paper sheet having a length equal to or smaller than a first length that fits in a paper cassette and a long paper sheet having a greater length than the first length, a paper conveyance path that conveys the paper sheet from the paper cassette joins the primary conveyance path.

7. The image forming apparatus according to claim 6, wherein an external paper conveyance path that conveys one of the paper sheet and the long paper sheet from outside joins the paper conveyance path.

8. The image forming apparatus according to claim 1, wherein, on an upstream side of the primary conveyance path in a direction of conveyance of a paper sheet having a length equal to or smaller than a first length that fits in a paper cassette and a long paper sheet having a greater length than the first length, an external paper conveyance path that conveys one of the paper sheet and the long paper sheet from outside joins the primary conveyance path.

9. The image forming apparatus according to claim 8, wherein a paper conveyance path that conveys the paper sheet from the paper cassette joins the external paper conveyance path.

10. The image forming apparatus according to claim 1, wherein the first conveyance path is located above the second conveyance path.

11. The image forming apparatus according to claim 1, wherein a paper cassette is located below the first conveyance path.

12. The image forming apparatus according to claim 1, wherein one edge of a long paper sheet before removal at a time of conveyance to the second conveyance path is conveyed in the first conveyance path toward a downstream side after entering the first conveyance path via the connecting conveyance path, the one edge being a top edge in a direction of conveyance of the long paper sheet.

13. The image forming apparatus according to claim 1, wherein a conveyance part including the second conveyance path and at least part of the first conveyance path can be pulled out of an apparatus main body.

14. The image forming apparatus according to claim 1, further comprising:

a retractor that retracts a conveyance member from the first conveyance path, the conveyance member being located in the first conveyance path at a position in contact with a long paper sheet being conveyed from the connecting conveyance path to the first conveyance path after conveyed in the second conveyance path in a forward direction; and a hardware processor that retracts the conveyance member from the first conveyance path with the retractor through an operation to convey the long paper sheet in the second conveyance path in a backward direction.

15. The image forming apparatus according to claim 14, wherein, after retracting the conveyance member, the hardware processor cancels the retraction of the conveyance member before a top edge of the next long paper sheet reaches the conveyance member, and returns the conveyance member to the position in contact with the next long paper sheet.

16. The image forming apparatus according to claim 1, further comprising a hardware processor that inversely rotates a conveyance member in a conveyance direction through an operation to convey a long paper sheet in the second conveyance path in a backward direction, the conveyance member being provided in the first conveyance path at a position in contact with the long paper sheet being conveyed from the connecting conveyance path to the first conveyance path after conveyed in the second conveyance path in a forward direction.

17. The image forming apparatus according to claim 16, wherein, after inversely rotating the conveyance member, the hardware processor switches the conveyance member from inverse rotation back to forward rotation before a top edge of the next long paper sheet reaches the conveyance member.

* * * * *